US012428837B2

(12) United States Patent
Haba et al.

(10) Patent No.: US 12,428,837 B2
(45) Date of Patent: Sep. 30, 2025

(54) DRYWALL TRACK COMPONENT, CLIPS FOR CONNECTING TO DRYWALL TRACK COMPONENT, DRYWALL TRACK COMPONENT ASSEMBLIES, AND METHODS OF MANUFACTURE THEREOF

(71) Applicant: TELLING INDUSTRIES, LLC, Willoughby, OH (US)

(72) Inventors: Charles Andrew Haba, Kirtland, OH (US); Thomas D. Ogle, York, SC (US)

(73) Assignee: Telling Industries, LLC, Willoughby, OH (US)

( * ) Notice: Subject to any disclaimer, the term of this patent is extended or adjusted under 35 U.S.C. 154(b) by 371 days.

(21) Appl. No.: 18/059,682

(22) Filed: Nov. 29, 2022

(65) Prior Publication Data

US 2023/0175255 A1 Jun. 8, 2023

Related U.S. Application Data

(60) Provisional application No. 63/264,786, filed on Dec. 2, 2021.

(51) Int. Cl.
*E04B 2/74* (2006.01)
*E04B 2/82* (2006.01)

(52) U.S. Cl.
CPC ..... *E04B 2/7457* (2013.01); *E04B 2/82* (2013.01)

(58) Field of Classification Search
CPC ..... E04B 2/767
See application file for complete search history.

(56) References Cited

U.S. PATENT DOCUMENTS 3,481,090 A * 12/1969 Lizee ..... E04B 2/825 52/241
3,863,412 A * 2/1975 Bodycomb ..... E04B 2/7457 52/346

(Continued)

OTHER PUBLICATIONS https://todayshomeowner.com/walls/guides/how-much-weight-can-drywall-hold/#:~:text=Ceilings%20are%20another%20matter%2C%20though%2C%20thanks%20to,a%20plant%20can%20easily%20reach%20that%20weight; Parker, Henry; Last updated Feb. 28, 2025. p. 1.

(Continued)

*Primary Examiner* — Joshua K Ihezie
(74) *Attorney, Agent, or Firm* — Sisson & Banyas, Attorneys at Law, LLC; Edwin A. Sisson; Jeffrey J. Banyas

(57) ABSTRACT

An embodiment of a drywall track component comprises at least a web, a first flange extending substantially perpendicular from a web first edge, a second flange extending substantially perpendicular from a web second edge, a first ledge extending substantially perpendicular from a first flange second edge, and a first track wall extending substantially perpendicular from a first ledge second edge. The drywall track component may include one or more inner clips removably connected to the first track wall and/or the second track wall. The inner clip(s) may comprise an inner clip top return lip, an inner clip vertical wall, and an inner clip bottom return lip. Another embodiment of a drywall track component comprises a web, a first flange extending substantially perpendicular from a web first edge, a second flange extending substantially perpendicular from a web second edge, a first outer clip removably connected to the first flange, and a second outer clip removably connected to the second flange. Each of the first outer clip and the second outer clip may comprise an outer clip top return lip, a ledge, (Continued)

an outer clip vertical wall, and an outer clip bottom return lip.

1 Claim, 21 Drawing Sheets

(56) References Cited

U.S. PATENT DOCUMENTS

| | | | | |
|---|---|---|---|---|
| 3,962,840 | A * | 6/1976 | Nelsson | E04B 2/7457 52/281 |
| 4,700,515 | A * | 10/1987 | Menchetti | E04F 21/1844 52/243.1 |
| 5,471,805 | A * | 12/1995 | Becker | E04B 2/7411 52/241 |
| 7,461,494 | B2 * | 12/2008 | Frezza | E02D 27/00 52/836 |
| 8,596,019 | B2 * | 12/2013 | Aitken | E04B 2/7457 52/710 |
| 10,487,497 | B1 * | 11/2019 | Aitken | E04F 13/14 |
| 11,702,850 | B2 * | 7/2023 | Cox | E04B 1/70 52/220.2 |
| 11,851,878 | B2 * | 12/2023 | Kushner | E04B 1/3483 |
| 11,993,928 | B2 * | 5/2024 | Marshall | E04B 1/388 |
| 2005/0155317 | A1 * | 7/2005 | Frezza | E04B 2/7457 52/745.19 |
| 2005/0183361 | A1 * | 8/2005 | Frezza | E02D 27/00 52/293.3 |
| 2007/0011969 | A1 * | 1/2007 | Little | E04F 13/042 52/415 |
| 2007/0163191 | A1 * | 7/2007 | Berry | E04B 2/7457 52/281 |
| 2007/0193187 | A1 * | 8/2007 | O'Connor | E04B 2/7457 52/653.1 |
| 2008/0041001 | A1 * | 2/2008 | Melton | E04F 21/1844 52/293.3 |
| 2018/0016838 | A1 * | 1/2018 | Haba | E04C 2/284 |
| 2018/0148925 | A1 * | 5/2018 | Rice | E04B 2/7457 |
| 2022/0074198 | A1 * | 3/2022 | Sessler | E04B 2/60 |
| 2022/0251821 | A1 * | 8/2022 | Cox | E04B 2/7457 |
| 2023/0009544 | A1 * | 1/2023 | Marshall | E04B 1/388 |
| 2023/0175255 | A1 * | 6/2023 | Haba | E04B 2/767 52/238.1 |
| 2024/0159053 | A1 * | 5/2024 | LeBlang | E04B 2/767 |

OTHER PUBLICATIONS https://www.thisisdrywall.com/p=448#:~:text=Consider%20weight%20of%20insulation%2C%20%C2%BD%20drywall%20can,the%20temperature%20and%20humidity%20of%20the%20interior, Ferguson, Myron R.; Apr. 22, 2014; last accessed Jun. 17, 2025. p. 3.

* cited by examiner

DRYWALL TRACK COMPONENT, CLIPS FOR CONNECTING TO DRYWALL TRACK COMPONENT, DRYWALL TRACK COMPONENT ASSEMBLIES, AND METHODS OF MANUFACTURE THEREOF

CROSS REFERENCES AND PRIORITIES

This application claims priority from U.S. Provisional Patent Application No. 63/264,786 filed on 2 Dec. 2021 the teachings of which are incorporated by reference herein in their entirety.

BACKGROUND

Typical metal framing track is secured to the floor and/or ceiling of a structure such as a house, office building, warehouse, or the like. Studs are then assembled into the track and secured before drywall sheets (also known as Gypsum) are mounted directly to the studs and the track.

In common metal framing track applications, the bottom edge of each drywall sheet (along with any insulation) rests directly on the floor. This makes the drywall sheets (and insulation) susceptible to water and other damage from floor cleaning equipment.

U.S. Pat. No. 8,596,019 B2 discloses systems for assembling drywall tracks that support drywall above the floor. The device disclosed therein comprises two components that are stackable within each other. Each component consists essentially of a base section that is substantially perpendicular to a lateral section. The lateral section includes a niche portion that is adapted for supporting drywall above the base section, preferably by at least 0.5 inches, more preferably by approximately 2.0 inches. The base section of each component is configured such that the base sections of the two components can be connected such that the components are in opposing relation to each other to form the drywall track.

Another solution for assembling drywall tracks that support drywall above the floor is disclosed in U.S. Pat. No. 10,487,497 B1. Like the device disclosed in U.S. Pat. No. 8,596,019 B2, the device disclosed in U.S. Pat. No. 10,487,497 B1 also comprises two components. Each component may comprise a base section and a lateral section. The base section may engage a first upright of the lateral section in a generally perpendicular manner. The first upright may engage a second upright in a generally parallel manner, and such that a gap may be formed between the interior surface of the first upright and the interior surface of the second upright. The first upright may engage the second upright at an end of the first upright that is opposite the end thereof at which the first upright engages the base section. Again, the base section of each component is configured such that the base sections of the two components can be connected such that the components are in opposing relation to each other to form the drywall track.

In practice, the solutions disclosed in the prior art have been found difficult and labor intensive to install. As opposed to traditional single piece metal framing tracks which do not support drywall above the floor, the two component designs of the prior art require installation of two separate components as shown in FIG. 21 thereby doubling the amount of labor time and fasteners needed for installation. In addition, the two components require precise parallel alignment along their entire length. Any deviation in parallel alignment can make the resulting drywall track too wide or too narrow to accept a stud and/or can result in an undesired asymmetrical wall.

The need exists, therefore, for an improved drywall track component which supports the drywall above the floor.

SUMMARY

It is described herein a drywall track component comprising a web, a first flange, a second flange, a first ledge, and a first track wall. The web having a web first edge, a web second edge, a web first end, and a web second end. The first flange extending substantially perpendicular from the web first edge and having a first flange first edge, a first flange second edge, a first flange first end, and a first flange second end. The second flange extending substantially perpendicular from the web second edge and having a second flange first edge, a second flange second edge, a second flange first end, and a second flange second end. The first ledge extending substantially perpendicular from the first flange second edge in a first direction towards the second flange and having a first ledge first edge, a first ledge second edge, a first ledge first end, and a first ledge second end. The first track wall extending substantially perpendicular from the first ledge second edge in a second direction away from the web and having a first track wall first edge, a first track wall second edge, a first track wall first end, and a first track wall second end.

The drywall track component may be configured to receive at least a first drywall sheet with the first ledge configured to abut against a bottom edge of the first drywall sheet, and the first track wall configured to connect to the first drywall sheet by at least one first fastener. In some embodiments, the drywall track component may be configured to receive at least a third drywall sheet with eh first ledge configured to abut against a bottom edge of the third drywall sheet, and the first track wall configured to connect to the third drywall sheet by the at least one fastener.

In certain embodiments, the drywall track component may further comprise a second ledge and a second track wall. The second ledge—when present—extends substantially perpendicular from the second flange second edge in a third direction towards the first flange and have a second ledge first edge, a second ledge second edge, a second ledge first end, and a second ledge second end. The second track wall—when present—extends substantially perpendicular from the second ledge second edge in a fourth direction away from the web and have a second track wall first edge, a second track wall second edge, a second track wall first end, and a second track wall second end.

In some embodiments comprising a second ledge and a second track wall, the drywall track component may be configured to receive at least a second drywall sheet with the second ledge configured to abut against a bottom edge of the second drywall sheet, and the second track wall configured to connect to the second drywall sheet by at least one second fastener. In certain such embodiments, the drywall track component may be configured to receive at least a fourth drywall sheet with the second ledge configured to abut against a bottom edge of the fourth drywall sheet, and the second track wall configured to connect to the fourth drywall sheet by the at least one second fastener.

It is also described herein an inner clip for connecting to a drywall track component, said inner clip comprising an inner clip top return lip, an inner clip vertical wall, and an inner clip bottom return lip. The inner clip top return lip comprising an inner clip lead-in and an inner clip fold. The inner clip top return lip may be configured to connect to the first track wall or the second track wall of the drywall track component.

In some embodiments, the inner clip lead-in may have an inner clip lead-in length dimension which is less than an inner clip vertical wall length dimension. In certain embodiments, the inner clip vertical wall may have an inner clip vertical wall length dimension which is substantially equal to a distance dimension between the first flange first edge and the first track wall second edge of the drywall track component, or which is substantially equal to a distance dimension between the second flange first edge and the second track wall second edge.

It is further described herein a drywall track component and inner clip assembly comprising a drywall track component, a first inner clip, and a second inner clip. The first inner clip is removably connected to the first track wall by passing the inner clip top return lip over the first track wall. The second inner clip is removably connected to a second track wall by passing the inner clip top return lip over the second track wall.

Also described herein is an outer clip for connecting to a channel, said outer clip comprising an outer clip top return lip, a ledge, an outer clip vertical wall, and an outer clip bottom return lip. The outer clip top return lip comprising an outer clip lead-in, an outer clip fold, and a vertical track wall having a vertical track wall edge. The ledge extending substantially perpendicular from the vertical track wall edge in a first direction away from the outer clip lead-in, and having a ledge first edge, a ledge second edge, a ledge first end, and a ledge second end. The outer clip vertical wall extending substantially perpendicular from the ledge second edge in a second direction away from the outer clip top return lip and having an outer clip vertical wall first edge, an outer clip vertical wall second edge, an outer clip vertical wall first end, and an outer clip vertical wall second end. The outer clip bottom return lip extending from the outer clip vertical wall second edge in a third direction towards the outer clip top return lip. The outer clip top return lip is configured to connect to a channel first flange or a channel second flange of the channel with the channel comprising the channel first flange, a channel web, and the channel second flange.

In some embodiments, the vertical track wall may comprise a first ridge. In certain embodiments, the outer clip lead-in may have an outer clip lead-in length dimension which is less than a vertical track wall length dimension of the vertical track wall.

In some embodiments, the outer clip may be configured to receive at least a first drywall sheet with the ledge configured to abut against a bottom edge of the first drywall sheet, and the vertical track wall configured to connect to the first drywall sheet by at least one first fastener. In certain such embodiments, the outer clip may be configured to receive at least a second drywall sheet with the ledge configured to abut against a bottom edge of the second drywall sheet, and the vertical track wall configured to connect to the second drywall sheet by at least one first fastener.

It is also described herein a drywall track component assembly comprising a channel, a first outer clip, and a second outer clip. The channel comprising a channel web, a channel first flange, and a channel second flange. The channel web having a channel web first edge, a channel web second edge, a channel web first end, and a channel web second end. The channel first flange extending substantially perpendicular from the channel web first edge and having a channel first flange first edge, a channel first flange second edge, a channel first flange first end, and a channel first flange second end. The channel second flange extending substantially perpendicular from the channel web second edge and having a channel second flange first edge, a channel second flange second edge, a channel second flange first end, and a channel second flange second end. The first outer clip is removably connected to the channel first flange by passing the outer clip top return lip over the channel first flange. The second outer clip is removably connected to the channel second flange by passing the outer clip top return lip over the channel second flange.

In some embodiments, the channel first flange may comprise a channel first bead while the vertical track wall of the first outer clip may comprise a first ridge. In such embodiments, the first ridge may be configured to frictionally engage with the channel first bead when the first outer clip is connected to the channel first flange.

In certain embodiments, the channel second flange may comprise a channel second bead while the vertical track wall of the second outer clip may comprise a second ridge. In such embodiments, the second ridge may be configured to frictionally engage with the channel second bead when the first outer clip is connected to the channel first flange.

In some embodiments, the drywall track component assembly may be configured to receive at least a first drywall sheet with the ledge of the first outer clip configured to abut against a bottom edge of the first drywall sheet, and the vertical track wall of the first outer clip configured to connect to the first drywall sheet by at least one first fastener. In certain such embodiments, the drywall track component assembly may be configured to receive at least a third drywall sheet with the ledge of the first outer clip configured to abut against a bottom edge of the third drywall sheet, and the vertical track wall of the first outer clip configured to connect to the third drywall sheet by the at least one first fastener.

In certain embodiments, the drywall track component assembly may be configured to receive at least a second drywall sheet with the ledge of the second outer clip configured to abut against a bottom edge of the second drywall sheet, and the vertical track wall of the second outer clip configured to connect to the second drywall sheet by at least one second fastener. In some such embodiments, the drywall track component assembly may be configured to receive at least a fourth drywall sheet with the ledge of the second outer clip configured to abut against a bottom edge of the fourth drywall sheet, and the vertical track wall of the second outer clip configured to connect to the fourth drywall sheet by the at least one second fastener.

It is further described herein a method of manufacturing an outer clip comprising the steps of: exposing a planar piece of metal to first rolls to form an outer clip lead-in, an outer clip fold, and a vertical track wall; exposing the planar piece of metal to second rolls to form a ledge; exposing the planar piece of metal to third rolls to form an outer clip vertical wall; and exposing the planar piece of metal to fourth rolls to form a bottom lip.

In some embodiments, the method may comprise the further step of exposing the planar piece of metal to additional rolls to form a ridge. Exposing the planar piece of metal to additional rolls, which is exposure to at least one more roll, to form the ridge may occur prior to or after the step of exposing the planar piece of metal to first rolls.

DETAILED DESCRIPTION

Figure 1:
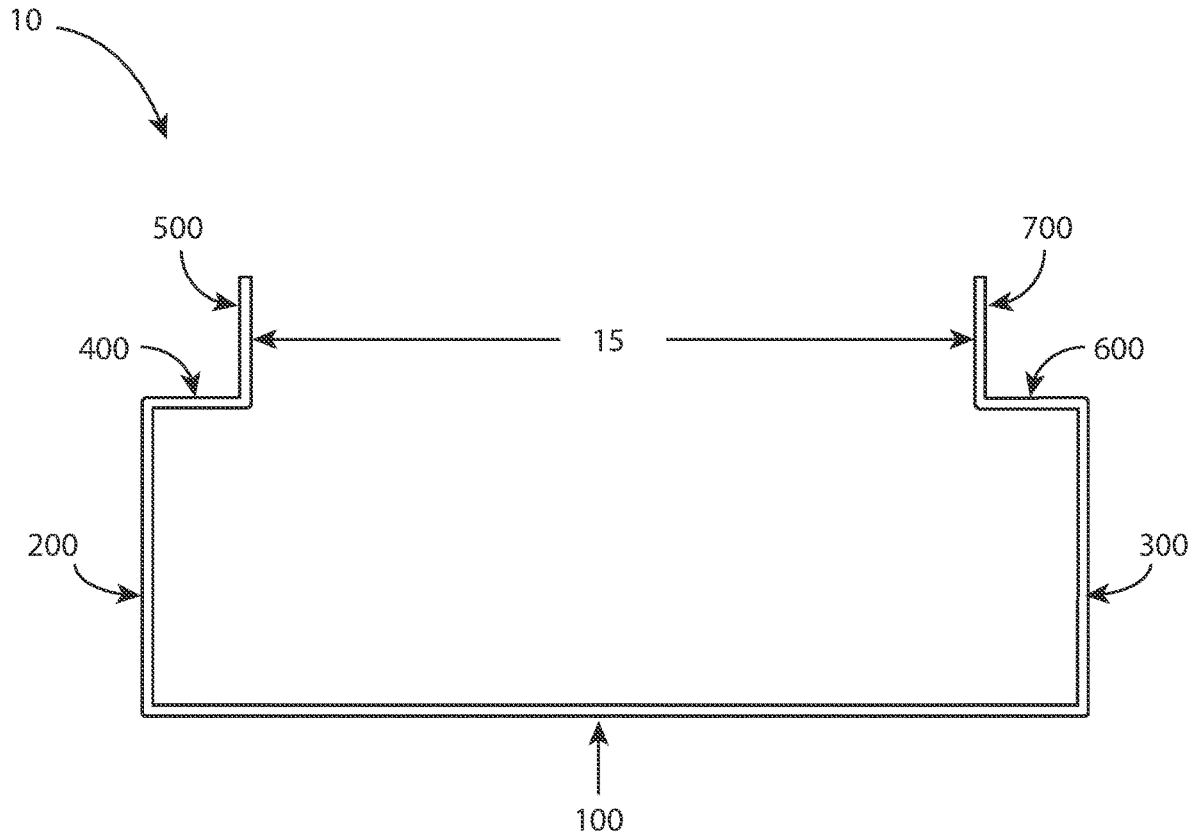
FIG. 1 is an end view of one embodiment of a drywall track component.

Disclosed herein is a drywall track component, an inner clip for connecting to a drywall track component, a drywall track component and inner clip assembly, an outer clip for connecting to a channel, and a drywall track component assembly. The drywall track component, inner clip for connecting to a drywall track component, drywall track component and inner clip assembly, outer clip for connecting to a channel, and drywall track component assembly are described below with reference to the Figures. As described herein and in the claims, the following numbers refer to the following structures as noted in the Figures.

5 refers to an outer clip.
7 refers to an inner clip.
10 refers to a drywall track component.
15 refers to a gap.
20 refers to a first drywall sheet.
22 refers to a bottom edge (of the first drywall sheet).
31 refers to a first fastener.
32 refers to a second fastener.
33 refers to a third fastener.
40 refers to a second drywall sheet.
42 refers to a bottom edge (of the second drywall sheet).
50 refers to a third drywall sheet.
52 refers to a bottom edge (of the third drywall sheet).
60 refers to a fourth drywall sheet.
62 refers to a bottom edge (of the fourth drywall sheet).
70 refers to a stud.
80 refers to a channel.
81 refers to a channel web.
82 refers to a channel first flange.
83 refers to a channel second flange.
84 refers to a channel first bead.
85 refers to a channel second bead.
86 refers to a channel gap.
100 refers to a web.
110 refers to a web first edge.
120 refers to a web second edge.
130 refers to a web first end.
140 refers to a web second end.
200 refers to a first flange.
210 refers to a first flange first edge.
220 refers to a first flange second edge.
230 refers to a first flange first end.
240 refers to a first flange second end.
300 refers to a second flange.
310 refers to a second flange first edge.
320 refers to a second flange second edge.
330 refers to a second flange first end.
340 refers to a second flange second end.
400 refers to a first ledge.
410 refers to a first ledge first edge.
420 refers to a first ledge second edge.
430 refers to a first ledge first end.
440 refers to a first ledge second end.
500 refers to a first track wall.
510 refers to a first track wall first edge.
520 refers to a first track wall second edge.
530 refers to a first track wall first end.
540 refers to a first track wall second end.
600 refers to a second ledge.
610 refers to a second ledge first edge.
620 refers to a second ledge second edge.
630 refers to a second ledge first end.
640 refers to a second ledge second end.
700 refers to a second track wall.
710 refers to a second track wall first edge.
720 refers to a second track wall second edge.
730 refers to a second track wall first end.
740 refers to a second track wall second end.
800 refers to an outer clip top return lip.
810 refers to an outer clip lead-in.
820 refers to an outer clip fold.
830 refers to a vertical track wall.
832 refers to a vertical track wall edge.
834 refers to a first ridge.
900 refers to a ledge.
910 refers to a ledge first edge.
920 refers to a ledge second edge.
930 refers to a ledge first end.
940 refers to a ledge second end.
1000 refers to an outer clip vertical wall.
1010 refers to an outer clip vertical wall first edge.
1020 refers to an outer clip vertical wall second edge.
1030 refers to an outer clip vertical wall first end.
1040 refers to an outer clip vertical wall second end.
1050 refers to an outer clip bottom return lip.
1100 refers to an inner clip top return lip.
1110 refers to an inner clip lead-in.

1115A refers to a curvature on the inner clip lead-in.

1115B refers to a curvature on the inner clip lead-in.

1120 refers to an inner clip fold.

1130 refers to an inner clip vertical wall.

1140 refers to an inner clip bottom return lip.

FIG. 1 depicts an end view of one embodiment of a drywall track component (10). The drywall track component in the embodiment of FIG. 1 comprises at least a web (100), a first flange (200), a second flange (300), a first ledge (400), and a first track wall (500). In preferred embodiments, the drywall track component may also comprise a second ledge (600) and a second track wall (700) as shown in FIG. 1.

Figure 2:
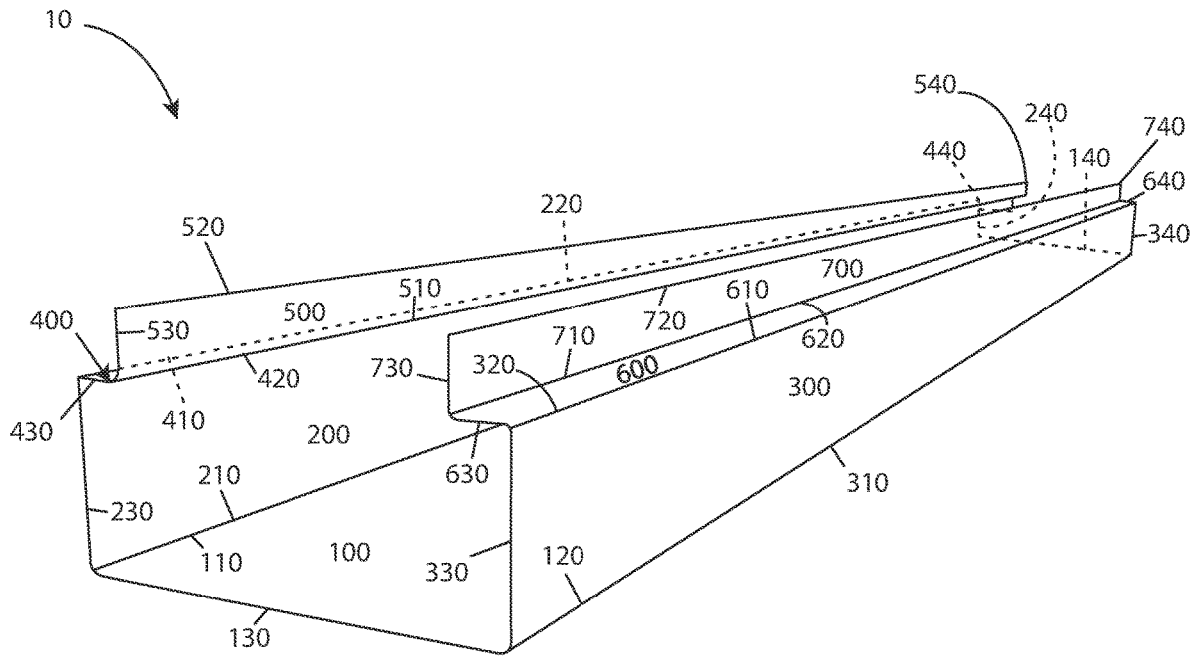
FIG. 2 is a perspective view of one embodiment of a drywall track component.

FIG. 2 depicts the embodiment of the drywall track component (10) from FIG. 1 in perspective view. In the embodiment shown in FIG. 1 and FIG. 2, each of the web (100), the first flange (200), the second flange (300), the first ledge (400), the first track wall (500), the (optional) second ledge (600), and the (optional) second track wall (700) have a substantially planar rectangular shape. That is to say that each of these components have a first edge, a second edge, a first end, and a second end with the first edge and the second edge being substantially parallel or parallel with one another, and the first end and the second end being substantially parallel or parallel with one another. The first end spans a distance between two opposing end points of the first edge and the second edge respectively while the second end spans a distance between two opposing end points of the first edge and the second edge respectively at the opposite end of the component.

That is to say that the web (100) comprises a web first edge (110) and a web second edge (120) which are substantially parallel or parallel with one another. The web further comprises a web first end (130) and a web second end (140) which are typically substantially parallel or parallel with one another. The web first end spans a distance between opposing end points of the web first edge and the web second edge. The web second end spans a distance between two opposing end points of the web first edge and the web second edge respectively at the opposite end of the web relative to the web first end.

Similarly, the first flange (200) comprises a first flange first edge (210) and a first flange second edge (220) which are substantially parallel or parallel with one another. The first flange further comprises a first flange first end (230) and a first flange second end (240) which are substantially parallel or parallel with one another. The first flange first end spans a distance between opposing end points of the first flange first edge and the first flange second edge. The first flange second end spans a distance between two opposing end points of the first flange first edge and the first flange second edge respectively at the opposite end of the first flange relative to the first flange first end.

The second flange (300) comprises a second flange first edge (310) and a second flange second edge (320) which are substantially parallel or parallel with one another. The second flange further comprises a second flange first end (330) and a second flange second end (340) which are substantially parallel or parallel with one another. The second flange first end spans a distance between opposing end points of the second flange first edge and the second flange second edge. The second flange second end spans a distance between two opposing end points of the second flange first edge and the second flange second edge respectively at the opposite end of the second flange relative to the second flange first end.

The first ledge (400) comprises a first ledge first edge (410) and a first ledge second edge (420) which are substantially parallel or parallel with one another. The first ledge further comprises a first ledge first end (430) and a first ledge second end (440) which are substantially parallel or parallel with one another. The first ledge first end spans a distance between opposing end points of the first ledge first edge and the first ledge second edge. The first ledge second end spans a distance between two opposing end points of the first ledge first edge and the first ledge second edge respectively at the opposite end of the first ledge relative to the first ledge first end.

The first track wall (500) comprises a first track wall first edge (510) and a first track wall second edge (520) which are substantially parallel or parallel with one another. The first track wall further comprises a first track wall first end (530) and a first track wall second end (540) which are substantially parallel or parallel with one another. The first track wall first end spans a distance between opposing end points of the first track wall first edge and the first track wall second edge. The first track wall second end spans a distance between two opposing end points of the first track wall first edge and the first track wall second edge respectively at the opposite end of the first track wall relative to the first track wall first end.

The second ledge (600) comprises a second ledge first edge (610) and a second ledge second edge (620) which are substantially parallel or parallel with one another. The second ledge further comprises a second ledge first end (630) and a second ledge second end (640) which are substantially parallel or parallel with one another. The second ledge first end spans a distance between opposing end points of the second ledge first edge and the second ledge second edge. The second ledge second end spans a distance between two opposing end points of the second ledge first edge and the second ledge second edge respectively at the opposite end of the second ledge relative to the second ledge first end.

The second track wall (700) comprises a second track wall first edge (710) and a second track wall second edge (720) which are substantially parallel or parallel with one another. The second track wall further comprises a second track wall first end (730) and a second track wall second end (740) which are substantially parallel or parallel with one another. The second track wall first end spans a distance between opposing end points of the second track wall first edge and the second track wall second edge. The second track wall second end spans a distance between two opposing end points of the second track wall first edge and the second track wall second edge respectively at the opposite end of the second track wall relative to the second track wall first end.

As shown in FIG. 1 and FIG. 2, the first flange (200) extends substantially perpendicular from or perpendicular from the web first edge (110) while the second flange (300) extends substantially perpendicular from or perpendicular from the web second edge (120). FIG. 1 and FIG. 2 also show the first ledge (400) extending substantially perpendicular from or perpendicular from the first flange second edge (220) in a first direction towards the second flange. The first track wall (500) extends substantially perpendicular from or perpendicular from the first ledge second edge (420) in a second direction away from the web.

FIG. 1 and FIG. 2 also show additional details of the (optional) second ledge (600) and second track wall (700). As shown in FIG. 1 and FIG. 2, the second ledge extends substantially perpendicular from or perpendicular from the second flange second edge (320) in a third direction towards the first flange (200). The second track wall then extends substantially perpendicular from or perpendicular from the second ledge second edge (620) in a fourth direction away from the web (100).

Figure 3:
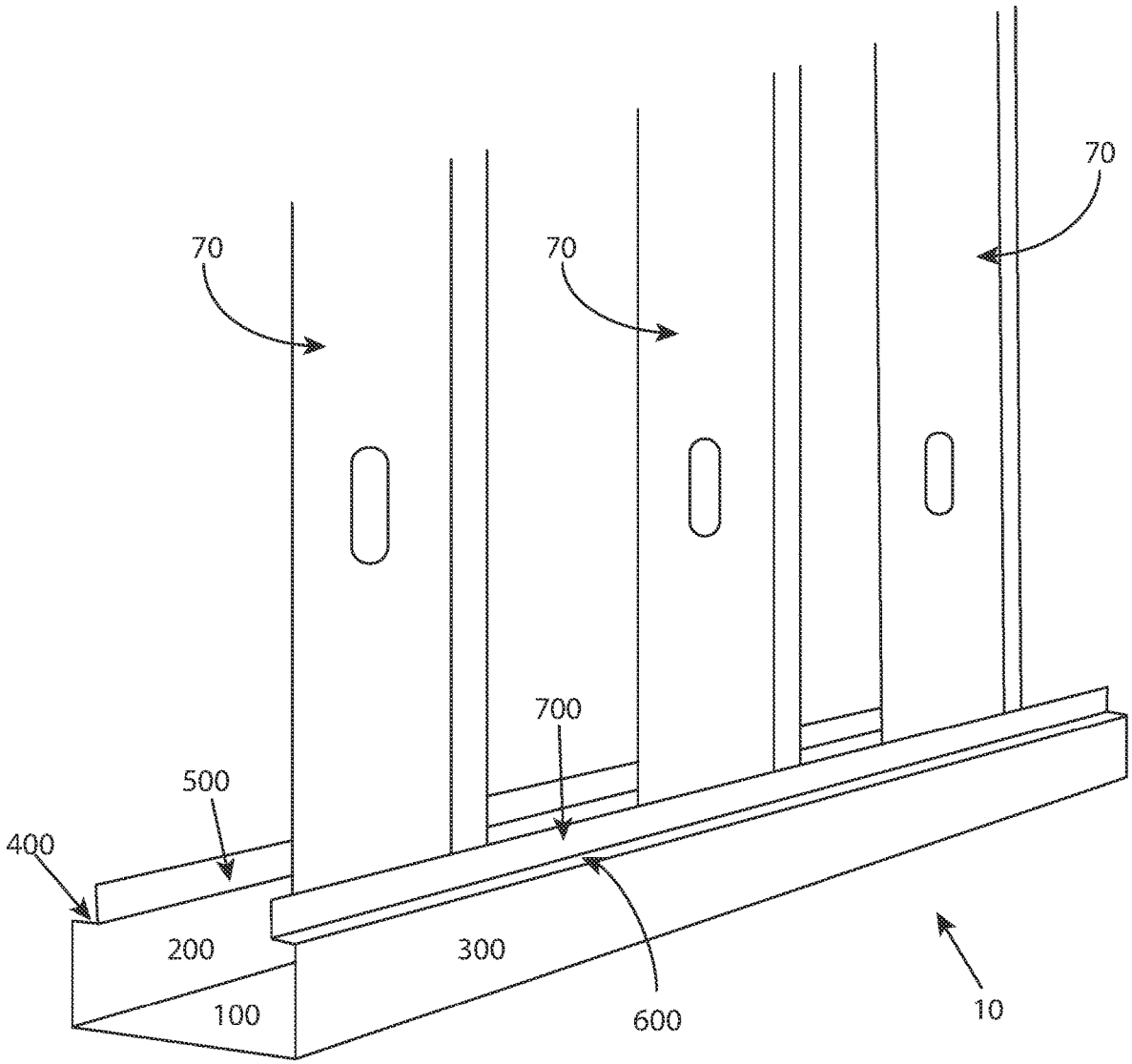
FIG. 3 is a perspective view of one embodiment of a drywall track component with studs installed therein.

Each of the first ledge (400) and the (optional) second ledge (600) will have a ledge width dimension measured parallel with the respective ledge first end (430/630) and/or ledge second end (440/640). Similarly, the web will have a web width dimension measured parallel with the web first end (130) and/or the web second end (140). The first ledge width dimension and the (optional) second ledge width dimension will be less than half the web width dimension such that a gap (15) exists between the first track wall and the (optional) second track wall (or the second flange in embodiments where there is no second track wall). This gap will preferably be sized to receive a plurality of studs (70), each of which are connected to the drywall track component (10) as shown in FIG. 3.

Figure 4:
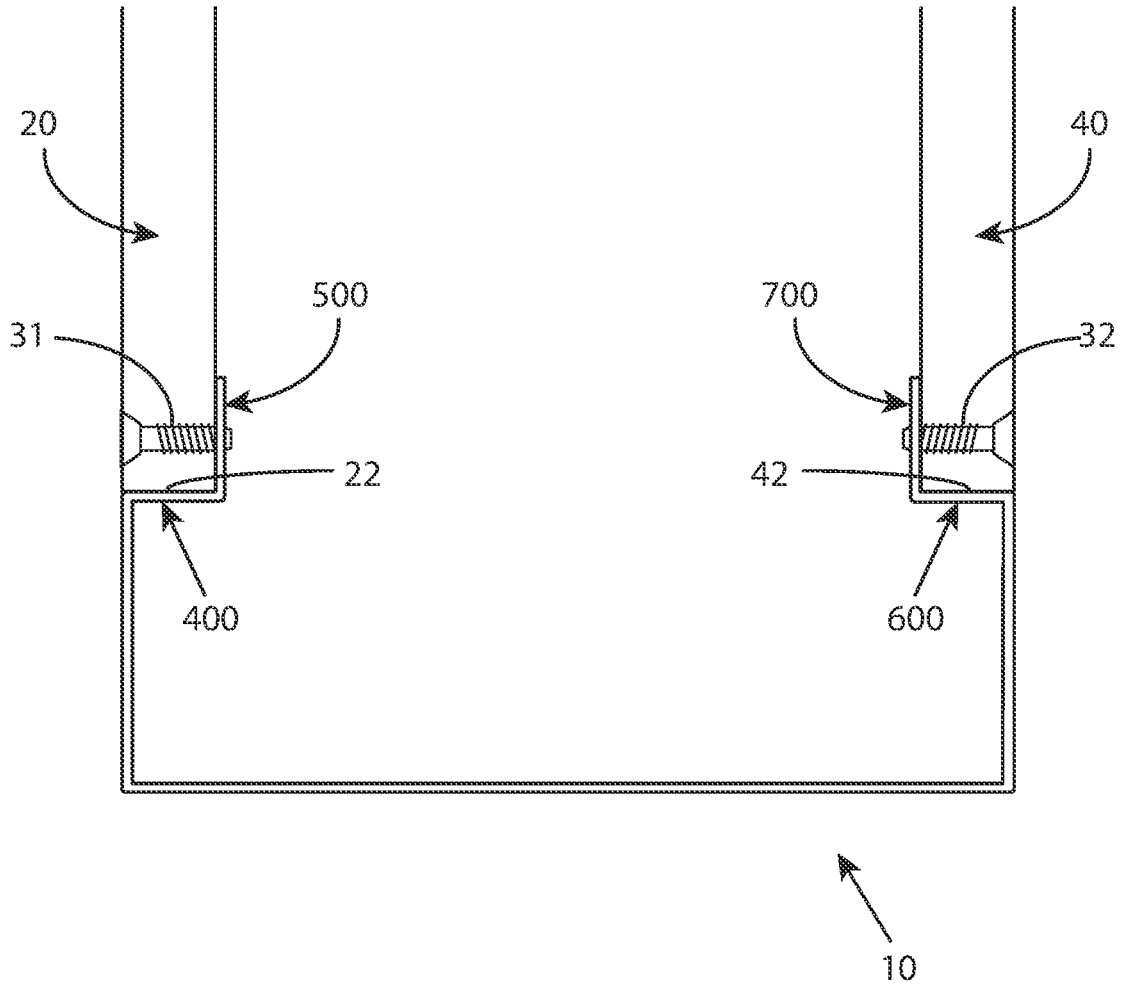
FIG. 4 is an end view of one embodiment of a drywall track component with two drywall sheets connected thereto.

The drywall track component (10) in the embodiment shown in FIG. 1 and FIG. 2 may be configured to receive at least a first drywall sheet (20). Once installed, the first ledge (400) is configured to abut against a bottom edge (22) of the first drywall sheet as shown in FIG. 4. The first track wall (500) is then configured to connect to the first drywall sheet by at least one first fastener (31) which is preferably a screw.

Similarly, FIG. 4 shows an (optional) second drywall sheet (40) which may be used in embodiments where the drywall track component (10) comprises a second ledge (600) and a second track wall (700). In such embodiments, the second ledge is configured to abut against a bottom edge (42) of the second drywall sheet as shown in FIG. 4. The second track wall is then configured to connect to the second drywall sheet by at least one second fastener (32) which is preferably a screw.

Figure 5:
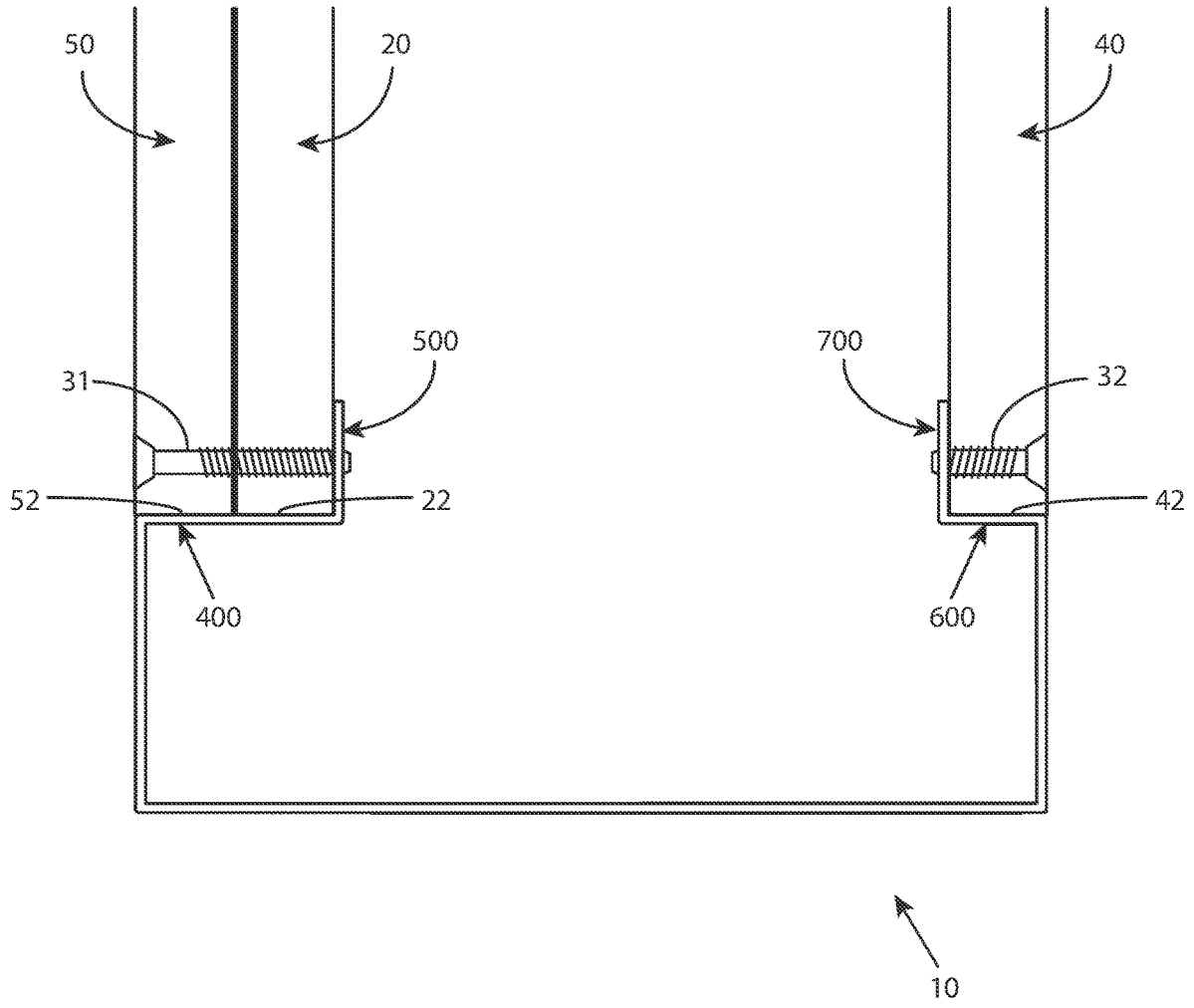
FIG. 5 is an end view of one embodiment of a drywall track component with three drywall sheets connected thereto.

In some embodiments the drywall track component (10) may be configured to have multiple layers of drywall on one or both sides of the drywall track component. For instance, FIG. 5 shows an embodiment of a drywall track component configured to receive two layers of drywall on the first flange (200) side of the drywall track component. This may be achieved by increasing the web width and first ledge width of the drywall track component. As shown in FIG. 5, in such embodiments, the first ledge (400) is configured to abut against a bottom edge (52) of the third drywall sheet (50). The first track wall (500) is then configured to connect to the third drywall sheet by at least the first fastener (31) which is preferably a screw that passes through both the third drywall sheet and the first drywall sheet (20) before passing into the first track wall as shown in FIG. 5.

Figure 6:
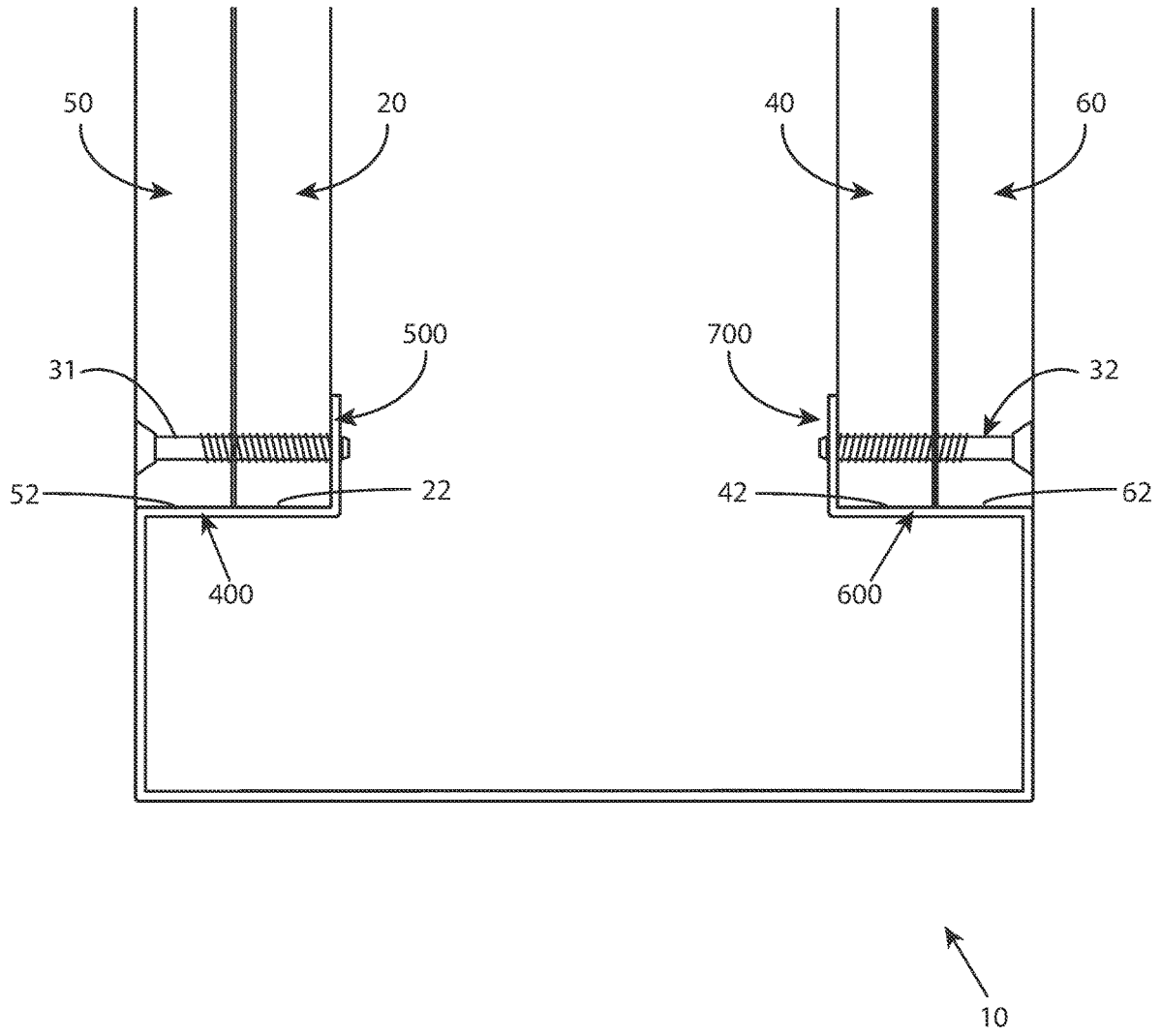
FIG. 6 is an end view of one embodiment of a drywall track component with four drywall sheets connected thereto.

Similarly, FIG. 6 shows an (optional) fourth drywall sheet (60) which may be used in embodiments where the drywall track component (10) comprises a second ledge (600) and a second track wall (700). The fourth drywall sheet, in conjunction with the second drywall sheet (40), forms two layers of drywall on the second flange (300) side of the drywall track component. This may be achieved by increasing the web width and the second ledge width of the drywall track component. As shown in FIG. 6, in such embodiments, the second ledge is configured to abut against a bottom edge (62) of the fourth drywall sheet (60). The second track wall is then configured to connect to the fourth drywall sheet by at least the second fastener (32) which is preferably a screw that passes through both the fourth drywall sheet and the second drywall sheet before passing into the second track wall as shown in FIG. 6.

Figure 7:
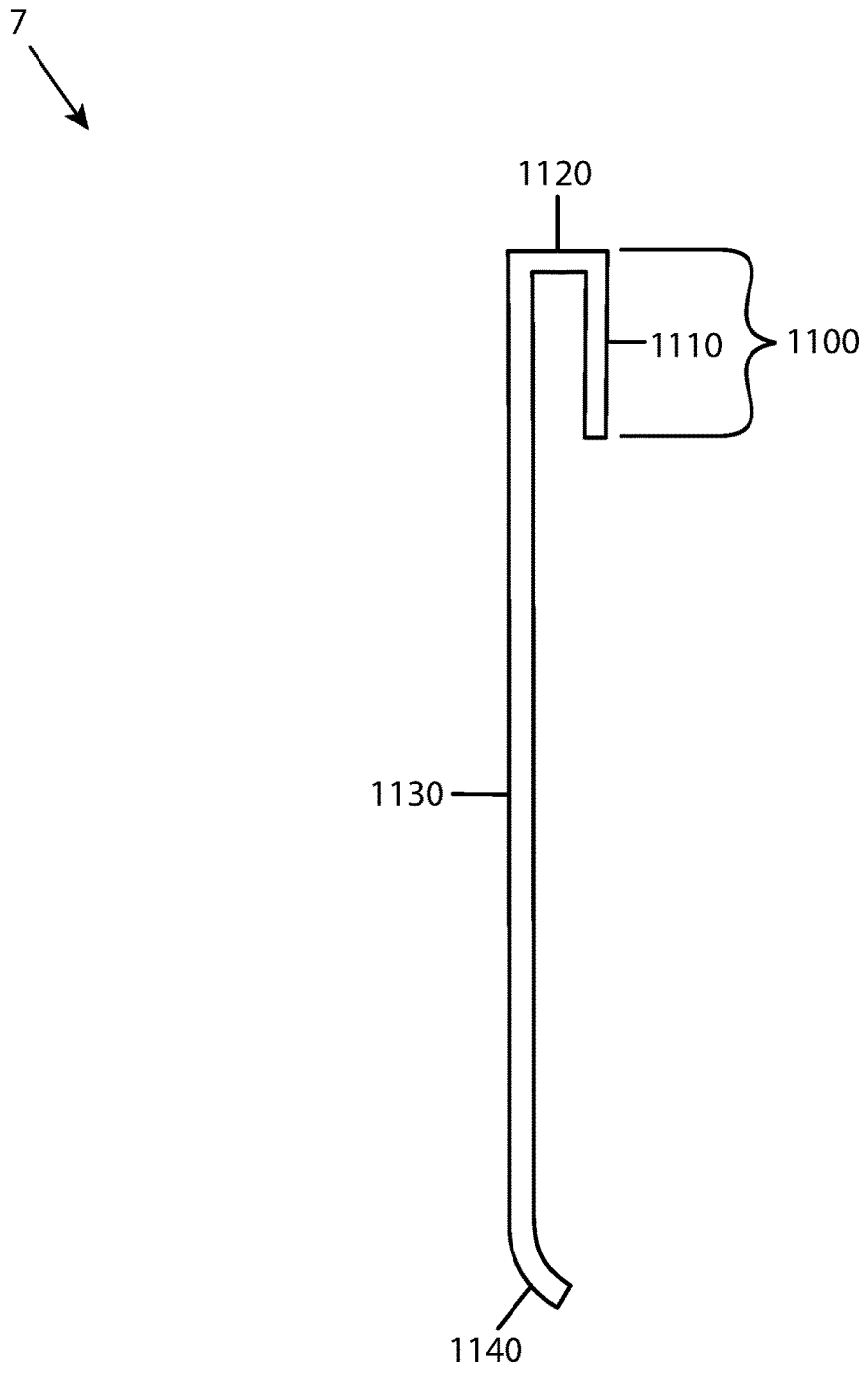
FIG. 7 is an end view of one embodiment of an inner clip.
Figure 10:
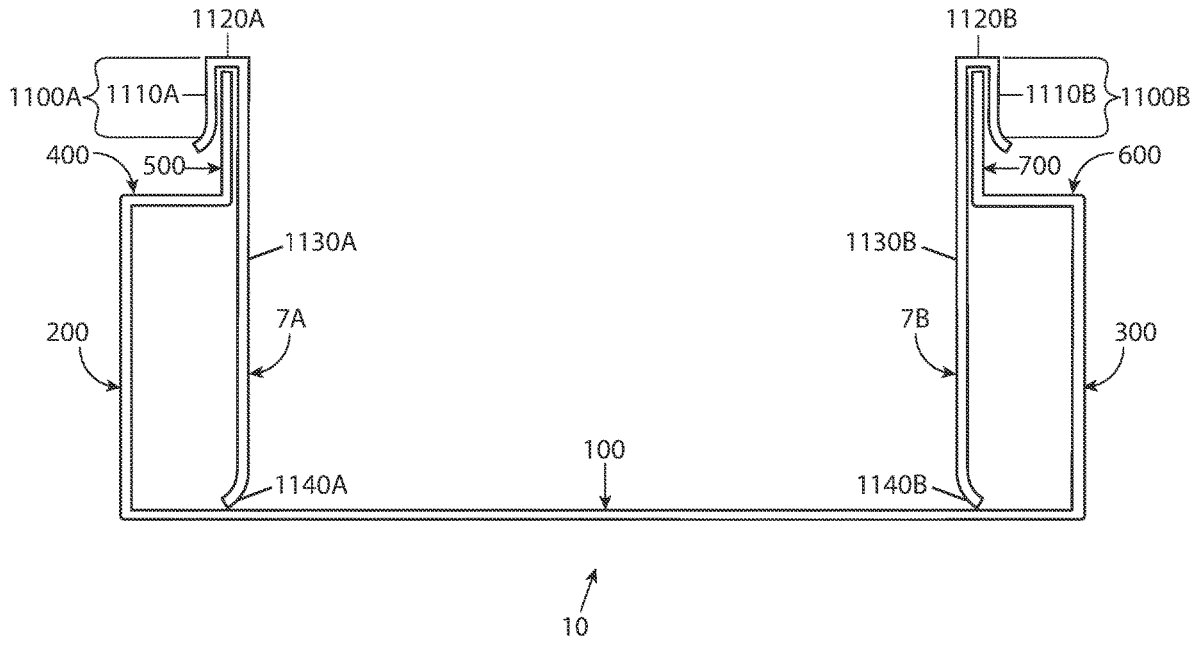
FIG. 10 is an assembled end view of the embodiment of a drywall track component comprising two inner clips of FIG. 9.

FIG. 7 shows an end view of an embodiment of an inner clip (7) for connecting to a drywall track component (10 as shown in FIG. 10) to form a drywall track component and inner clip assembly. The inner clip in the embodiment in FIG. 7 comprises an inner clip top return lip (1100), an inner clip vertical wall (1130); and an (optional) inner clip bottom return lip (1140).

The inner clip top return lip (1100) comprises an inner clip lead-in (1110). The inner clip lead-in is connected to the inner clip vertical wall (1130) by an inner clip fold (1120). The inner clip fold is preferably configured to form an arch of about 180° such that the inner clip lead-in and the inner clip vertical wall are substantially parallel with or parallel with one another as shown in FIG. 7. Preferably, the inner clip lead-in will have an inner clip lead-in length dimension which is less than the inner clip vertical wall length dimension as shown in FIG. 7. While FIG. 7 shows a straight lead-in, a lead-in with a curved end is also conceived, and in fact preferred. FIGS. 8, 9, 10, and 11 show the lead-in with the curved end. The lead-in with the curved end is labeled 1115A (referring to the inner clip top return lip (1100A) of the first inner clip (7A)) and 1115B (referring to the inner clip top return lip (1100B) of the second inner clip (7B) in FIG. 9.

Figure 8:
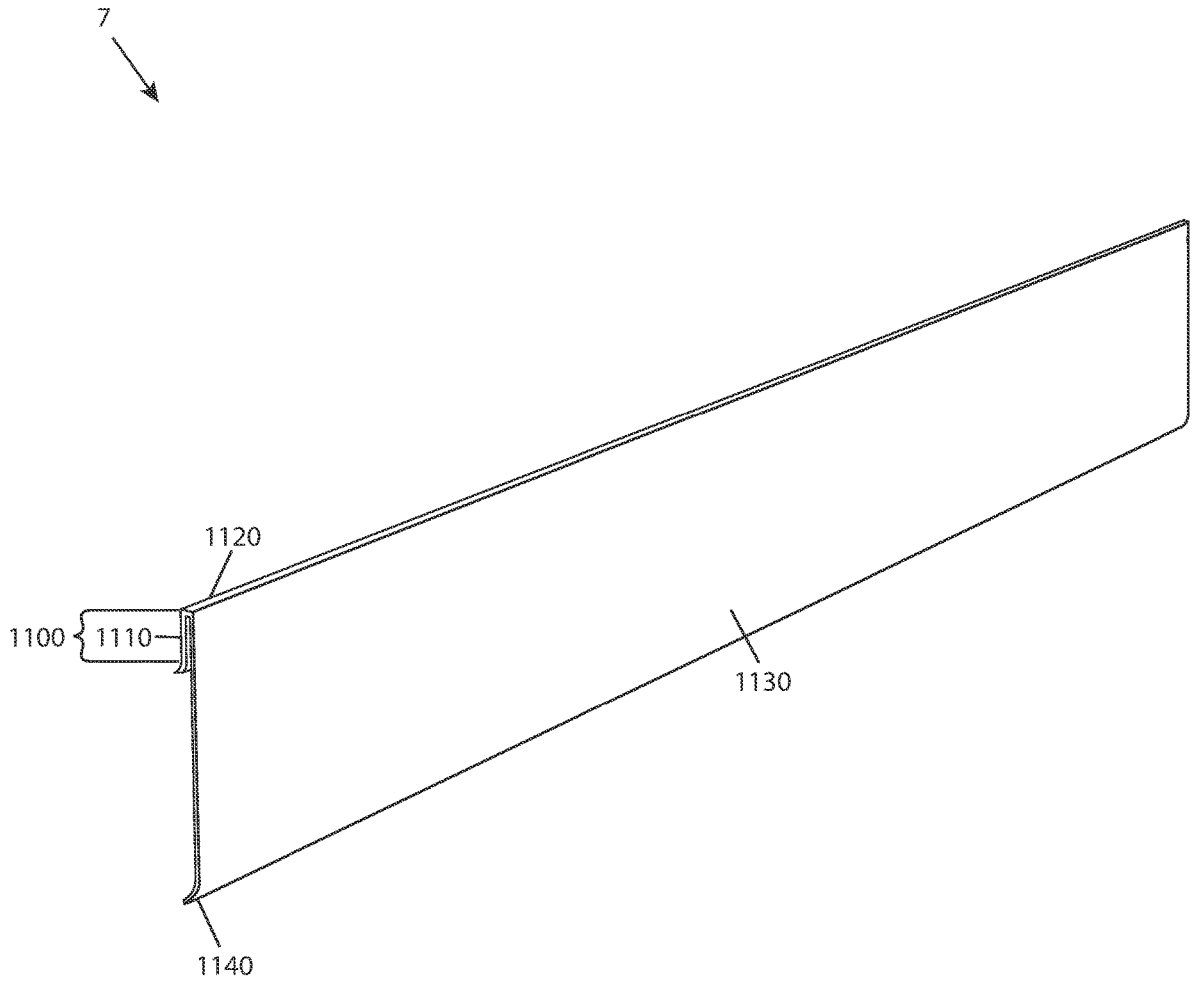
FIG. 8 is a perspective view of the embodiment of an inner clip of FIG. 7.

FIG. 8 depicts the embodiment of an inner clip (7) from FIG. 7 in perspective view. In the embodiment shown in FIG. 7 and FIG. 8, the inner clip vertical wall (1130) has a substantially planar rectangular shape. That is to say that the inner clip vertical wall has a first edge, a second edge, a first end, and a second end with the first edge and the second edge being substantially parallel or parallel with one another, and the first end and the second end being substantially parallel with one another. The first end spans a distance between two opposing end points of the first edge and the second edge respectively while the second end spans a distance between two opposing end points of the first edge and the second edge respectively at the opposite end of the inner clip vertical wall.

Figure 9:
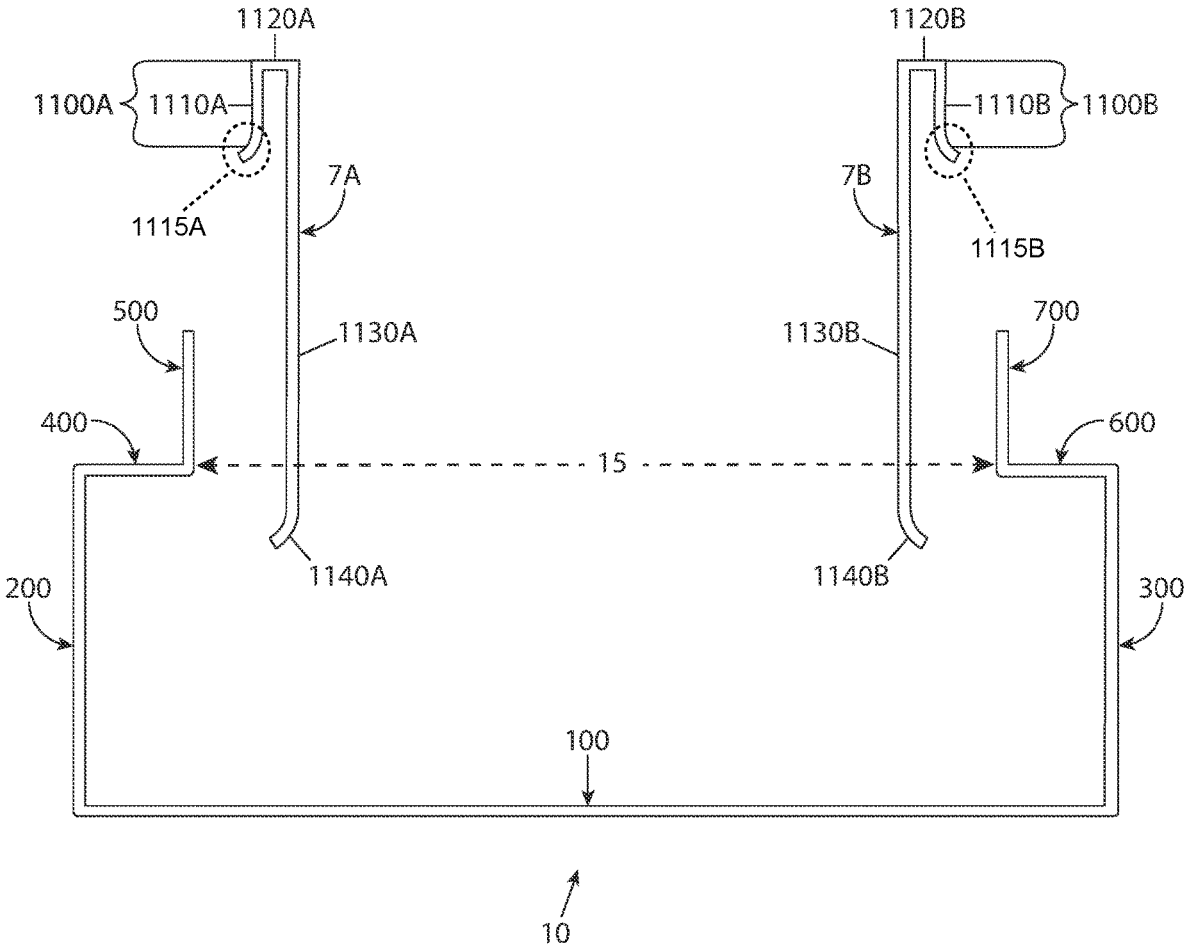
FIG. 9 is an exploded end view of one embodiment of a drywall track component comprising two inner clips of the type shown in FIG. 7 and FIG. 8.

As shown in FIG. 9 and FIG. 10, the inner clip (7) may be configured to frictionally engage with a drywall track component (10) of the type shown in FIG. 1 through FIG. 6 to form a drywall track component and inner clip assembly. This may be achieved by configuring the inner clip top return lip to connect to the first track wall (500) or the second track wall (700) of the drywall track component.

In the drywall track component and inner clip assembly there may be at least two inner clips—referred to herein as the first inner clip (7A) and the second inner clip (7B). The first inner clip may be removably connected to the first track wall (500) by passing the inner clip top return lip (1100A) of the first inner clip over the first track wall. Similarly, the second inner clip may be removably connected to the second track wall (700) by passing the inner clip top return lip (1100B) of the second inner clip over the second track wall.

As shown in FIG. 10, once assembled, a bottom edge of the clip (which may be the bottom edge of the inner clip vertical wall (1130) or a bottom edge of the (optional) inner clip bottom return lip) may rest against a portion of the web (100). This may be achieved by configuring the inner clip such that the inner clip vertical wall has an inner clip vertical wall length dimension which is substantially equal to a distance dimension between the first flange first edge (210) and the first track wall second edge of (520) of the drywall track component (10) in embodiments where the inner clip is configured to be removably connected to the first track wall (500). In embodiments where the inner clip is configured to be removably connected to the second track wall (700), this may be achieved by configuring the inner clip such that the inner clip vertical wall has an inner clip vertical wall length dimension which is substantially equal to a distance dimension between the second flange first edge (310) and the second track wall second edge (720) of the drywall track component. Once assembled, the inner clip vertical wall in combination with the first flange (200) forms a double walled configuration with an air pocket which acts as an insulator for both sound and in the event of a fire thereby improving both the acoustical performance and fire safety of the wall.

Figure 11:
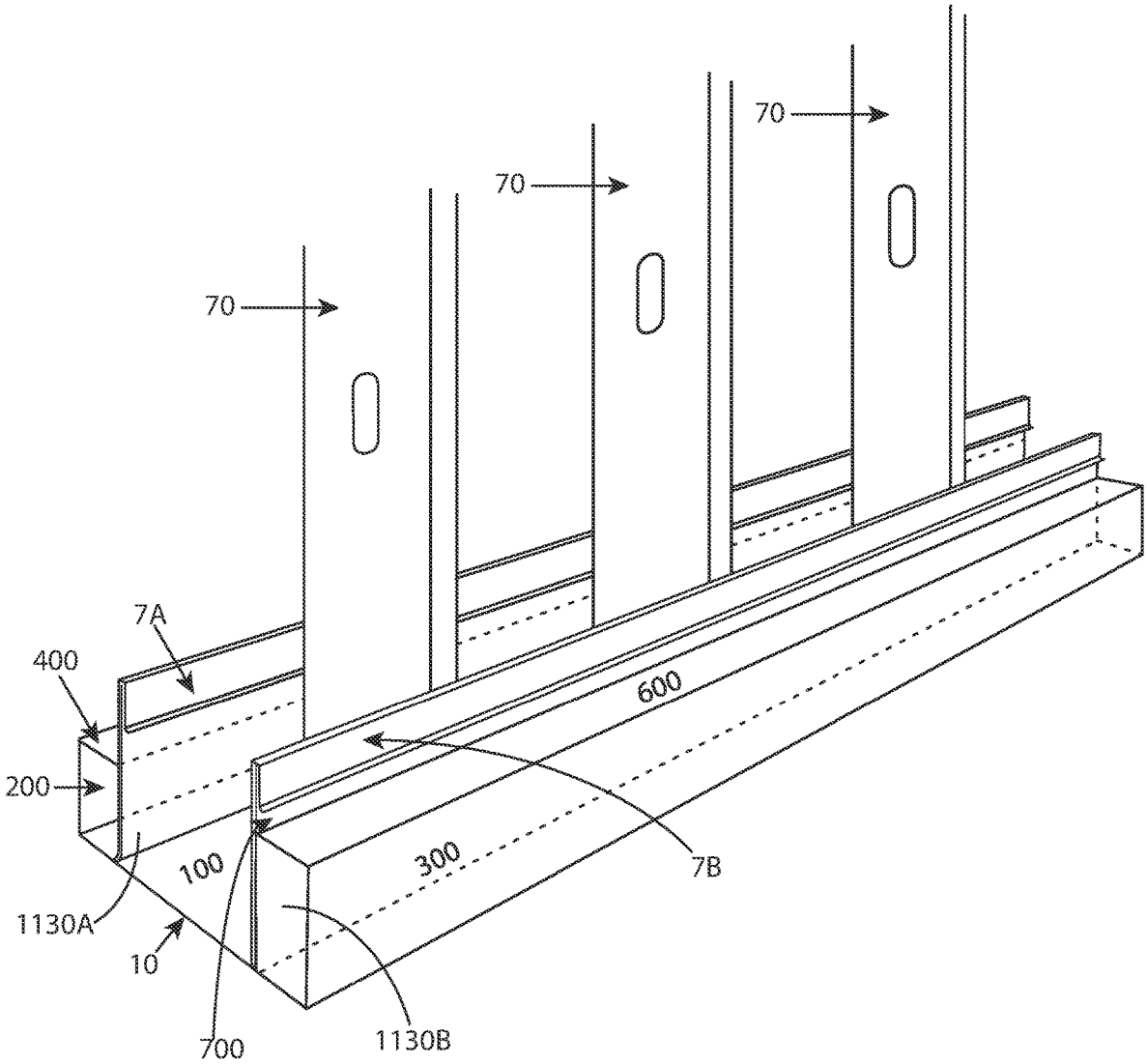
FIG. 11 is a perspective view of one embodiment of a drywall track component with studs installed therein.

In the drywall track component and inner clip assembly, the first ledge width dimension and the (optional) second ledge width dimension will be less than half the web width dimension such that a gap (15) exists between the first track wall and the (optional) second track wall (or the second flange in embodiments where there is no second track wall). This gap will preferably be sized to receive a plurality of studs (70), each of which are connected to the drywall track component (10) as shown in FIG. 11. The drywall track component and inner clip assembly may then receive one or more drywall sheets as shown in any of FIG. 4 through FIG. 6.

Figure 12:
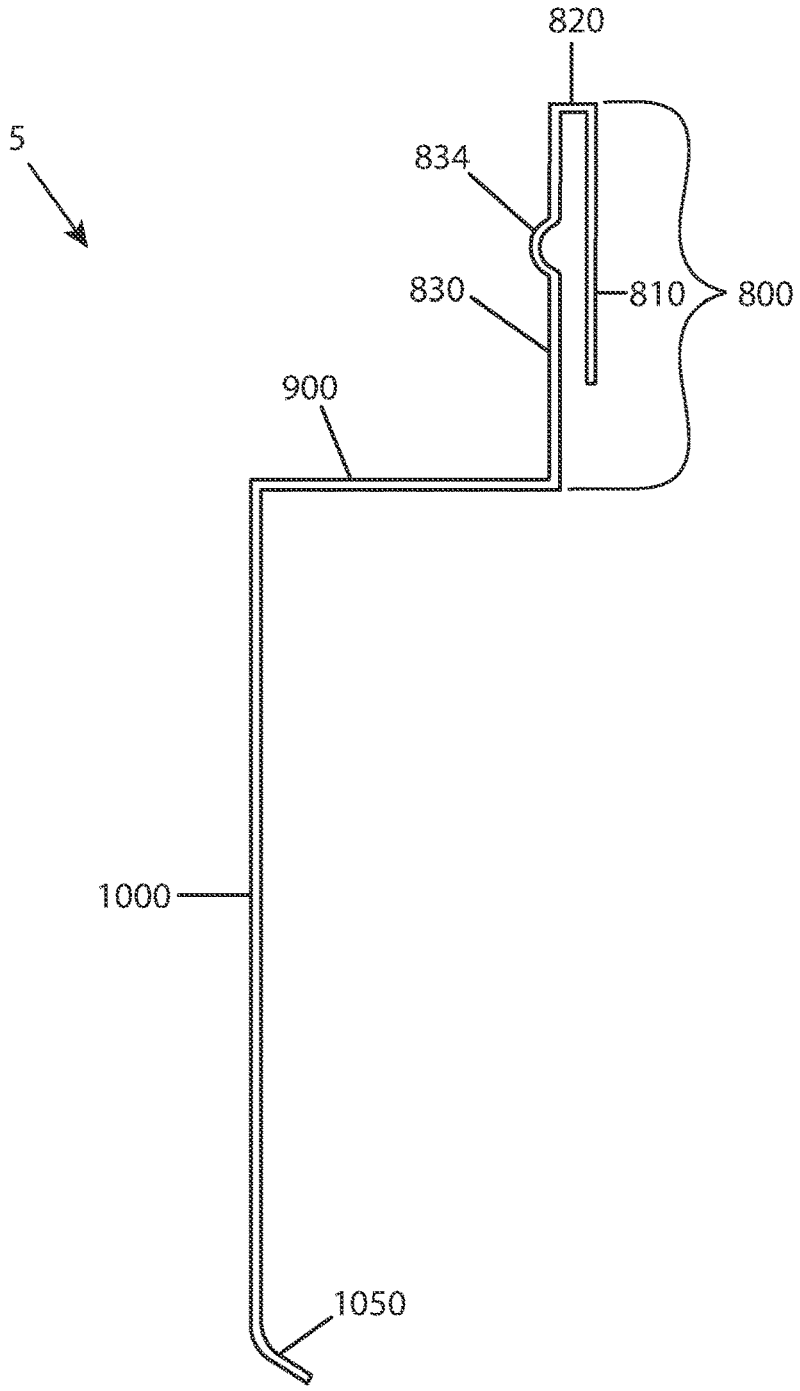
FIG. 12 is an end view of one embodiment of an outer clip.
Figure 14:
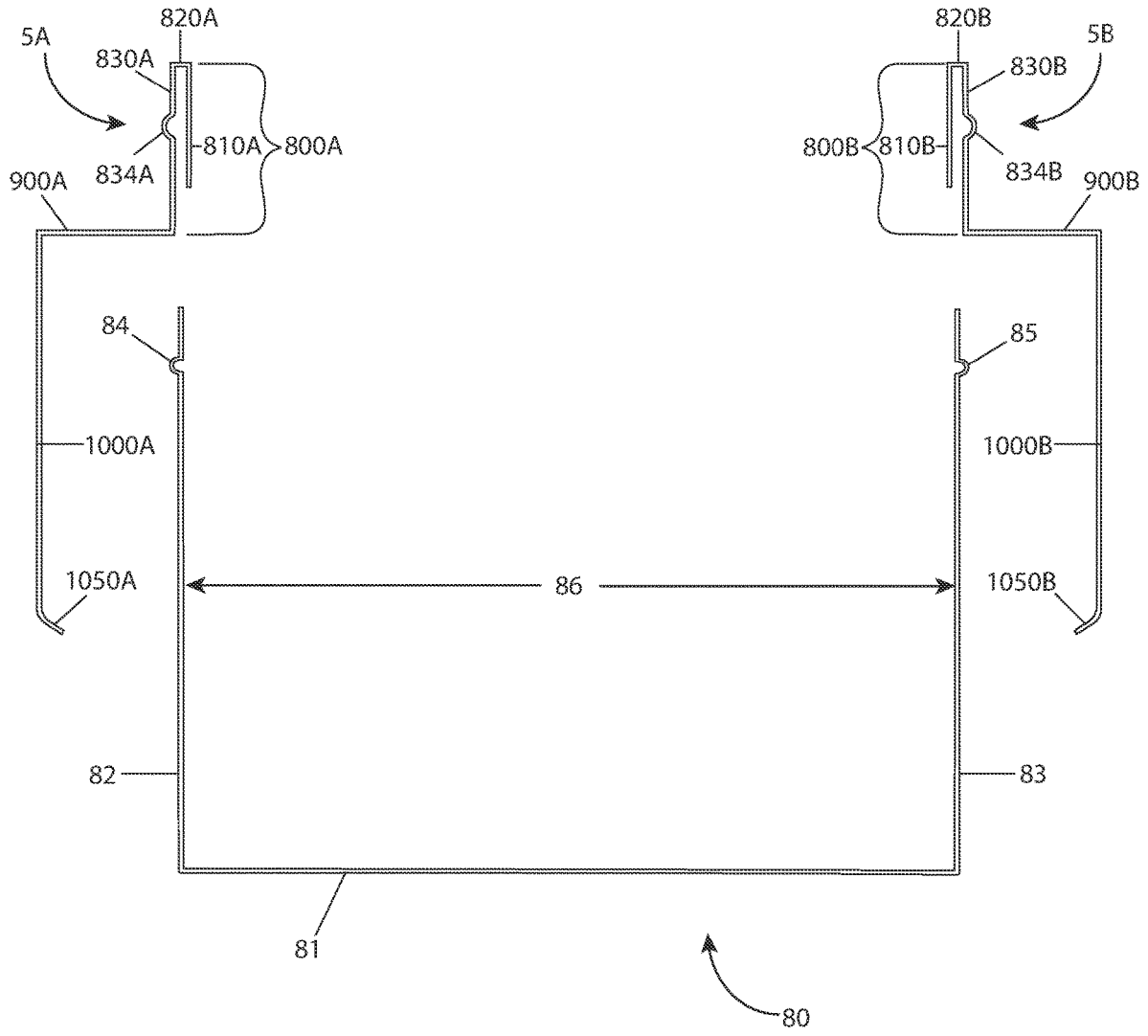
FIG. 14 is an exploded end view of one embodiment of a drywall track component comprising two outer clips of the type shown in FIG. 12 and FIG. 13.

FIG. 12 shows an end view of an embodiment of an outer clip (5) for connecting to a channel (80 as shown in FIG. 14) to form a drywall track component assembly. The outer clip in the embodiment in FIG. 12 comprises an outer clip top return lip (800), a ledge (900), an outer clip vertical wall (1000) and an (optional) outer clip bottom return lip (1050).

The outer clip top return lip (800) comprises an outer clip lead-in (810). The outer clip lead-in is the connected to a vertical track wall (830) by an outer clip fold (820). The outer clip fold is preferably configured to form an arch of about 180° such that the outer clip lead-in and the vertical track wall are substantially parallel with or parallel with one another as shown in FIG. 12. Preferably the outer clip lead-in will have an outer clip lead-in length dimension which is less than the vertical track wall length dimension of the vertical track wall as shown in FIG. 12. Optionally, the vertical track wall may also comprise a first ridge (834) as shown in FIG. 12.

Figure 13:
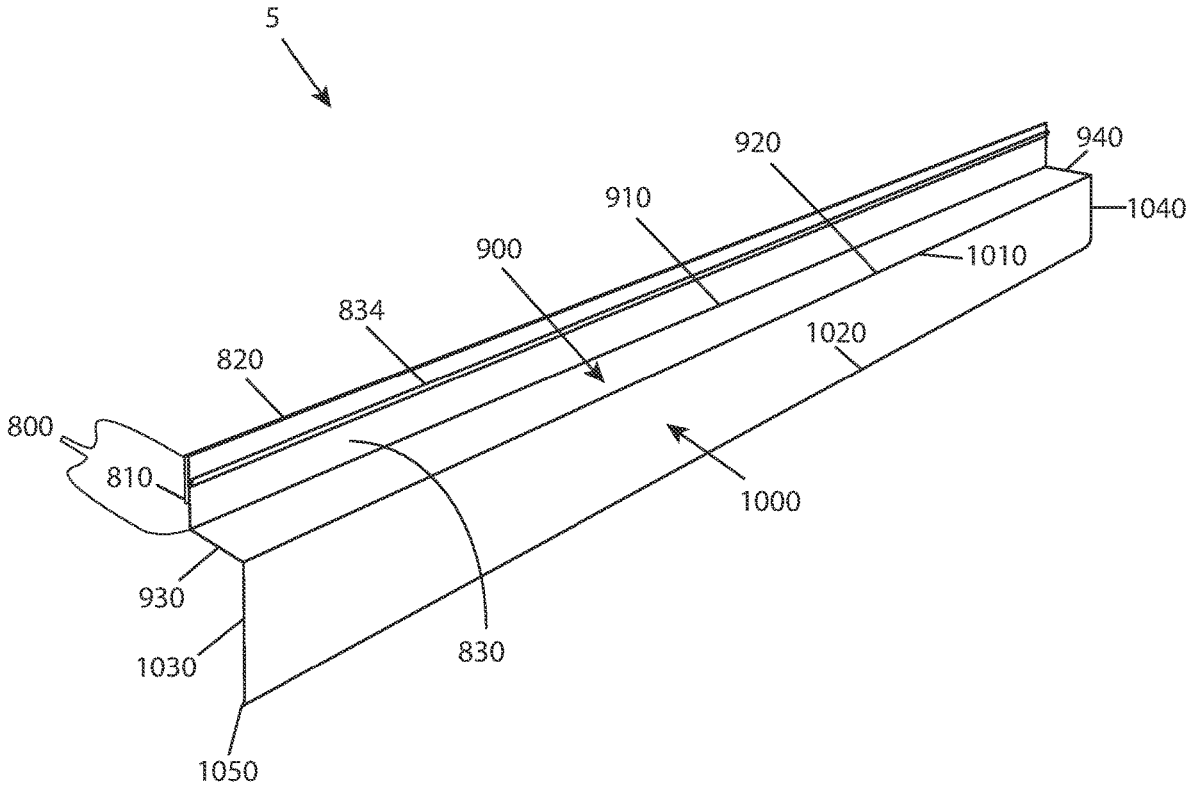
FIG. 13 is a perspective view of the embodiment of an outer clip of FIG. 12.

FIG. 13 depicts the embodiment of an outer clip (5) from FIG. 12 in perspective view. In the embodiment shown in FIG. 12 and FIG. 13, each of the ledge (900) and the outer clip vertical wall (1000) have a substantially planar rectangular shape. That is to say that each of these components have a first edge, a second edge, a first end, and a second end with the first edge and the second edge being substantially parallel or parallel with one another, and the first end and the second end being substantially parallel or parallel with one another. The first end spans a distance between two opposing end points of the first edge and the second edge respectively while the second end spans a distance between two opposing end points of the first edge and the second edge respectively at the opposite end of the component.

That is to say that the ledge (900) comprises a ledge first edge (910) and a ledge second edge (920) which are substantially parallel or parallel with one another. The ledge further comprises a ledge first end (930) and a ledge second end (940) which typically are substantially parallel or parallel with one another. The ledge first end spans a distance between opposing end points of the ledge first edge and the ledge second edge. The ledge second end spans a distance between two opposing end points of the ledge first edge and the ledge second edge respectively at the opposite end of the ledge relative to the ledge first end.

The outer clip vertical wall (1000) comprises an outer clip vertical wall first edge (1010) and an outer clip vertical wall second edge (1020) which are substantially parallel or parallel with one another. The outer clip vertical wall further comprises an outer clip vertical wall first end (1030) and an outer clip vertical wall second end (1040) which are substantially parallel or parallel with one another. The outer clip vertical wall first end spans a distance between opposing end points of the outer clip vertical wall first edge and the outer clip vertical wall second edge. The outer clip vertical wall second end spans a distance between two opposing end points of the outer clip vertical wall first edge and the outer clip vertical wall second edge respectively at the opposite end of the outer clip vertical wall relative to the outer clip vertical wall first end.

As shown in FIG. 12 and FIG. 13, the ledge (900) extends substantially perpendicular from or perpendicular from the vertical track wall edge (832) in a first direction away from the outer clip lead-in. The outer clip vertical wall (1000) then extends substantially perpendicular from the ledge second edge (920) in a second direction away from the outer clip top return lip. The (optional) outer clip bottom return lip (1050) then extends from the outer clip vertical wall second edge (1020) in a third direction towards the outer clip top return lip (800).

Figure 15:
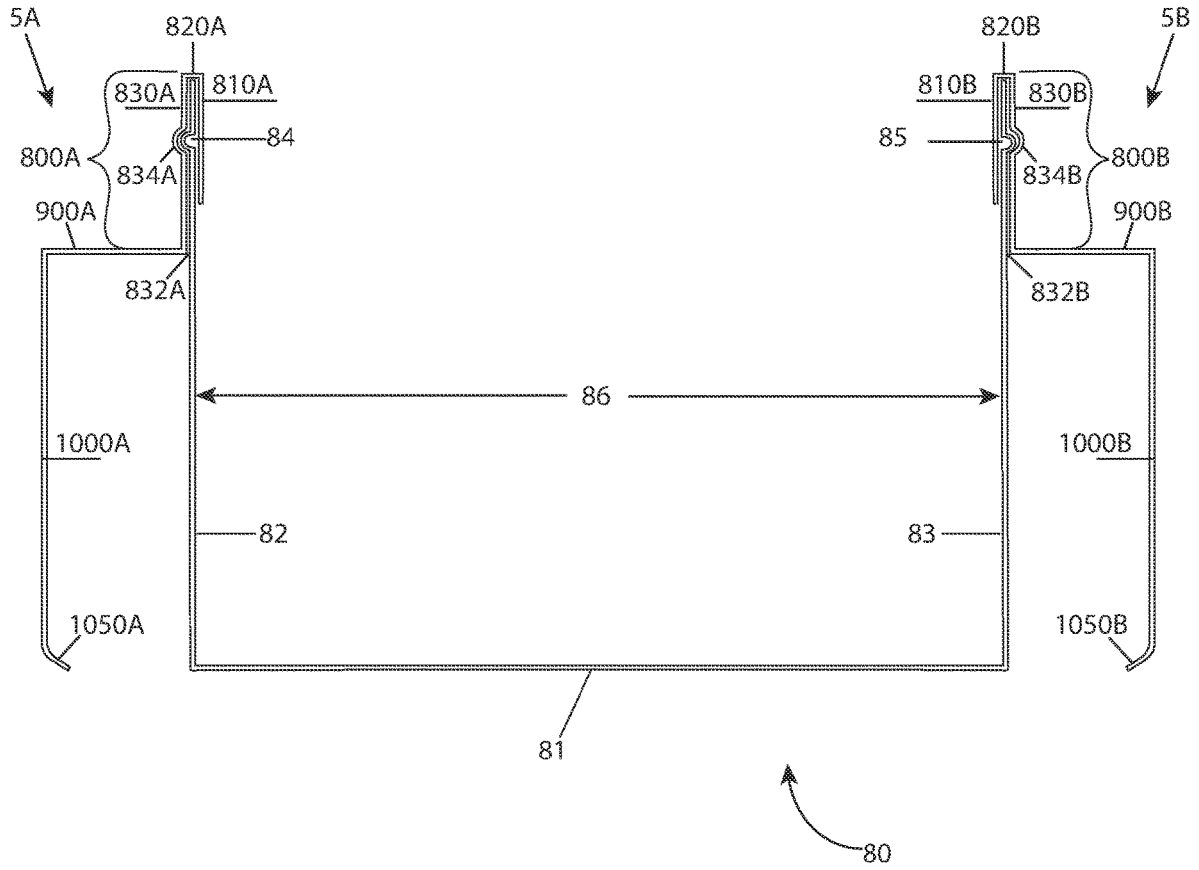
FIG. 15 is an assembled end view of the embodiment of a drywall track component comprising two outer clips of FIG. 14.

The outer clip (5) may be configured to frictionally engage with a channel (80) to form a drywall track component assembly as shown in FIG. 14 and FIG. 15 with the channel comprising a channel web (81), a channel first flange (82), and a channel second flange (83). This may be achieved by configuring the outer clip top return lip (800) to connect to the channel first flange or the channel second flange of the channel.

In the drywall track component assembly, there is at least a first outer clip (5A) which is removably connected to the channel first flange (82). Optionally, there may also be a second outer clip (5B) which is removably connected to the channel second flange (83). The connection between the first outer clip and the channel first flange is preferably a removable connection achieved by a friction fit between the outer clip top return lip (800A) of the first outer clip and the channel first flange. Similarly, the connection between the second outer clip (when present) and the channel second flange is preferably a removable connection achieved by a friction fit between the outer clip top return lip (800B) of the second outer clip and the channel second flange.

In some embodiments, the channel first flange (82) may comprise a channel first bead (84) while the vertical track wall (830A) of the first outer clip (5A) may comprise a first ridge (834A) as shown in FIG. 14. The first ridge may be configured to frictionally engage with the channel first bead when the first outer clip is connected to the channel first flange as shown in FIG. 15. This frictional engagement between the first ridge and the channel first bead may assist in holding the first outer clip in place on the channel first flange during assembly of the wall.

Similarly, in embodiments comprising a second outer clip (5B), the channel second flange (83) may comprise a channel second bead (85) while the vertical track wall (830B) of the second outer clip (5B) may comprise a second ridge (834B) as shown in FIG. 14. The second ridge may be configured to frictionally engage with the channel second bead when the second outer clip is connected to the channel second flange as shown in FIG. 15. This frictional engagement between the second ridge and the channel second bead may assist in holding the second outer clip in place on the channel second flange during assembly of the wall.

Figure 16:
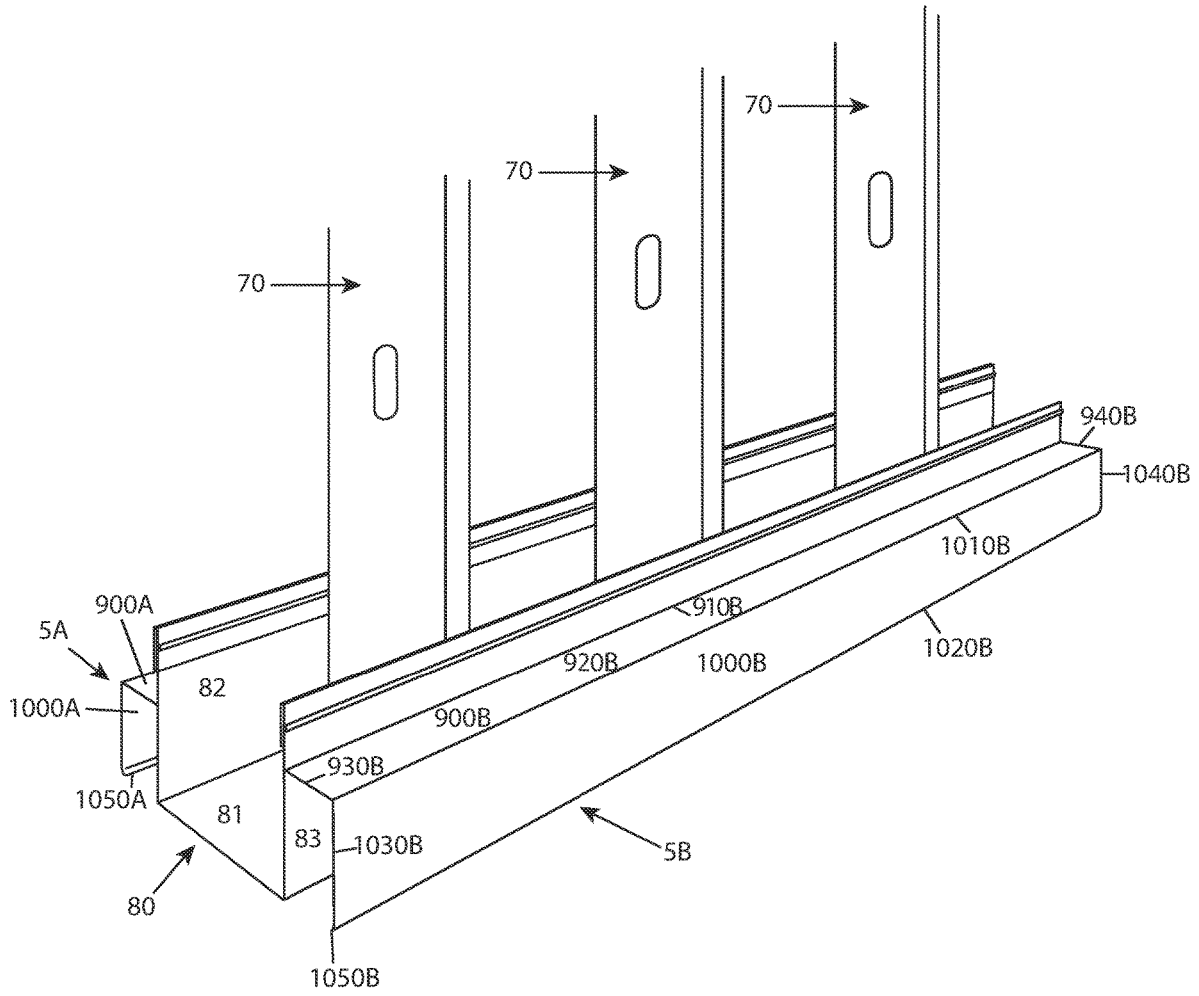
FIG. 16 is a perspective view of one embodiment of a drywall track component with studs installed therein.

In the drywall track component assembly, the channel web (81) will have a web width dimension measured parallel with the channel web first end and/or the channel web second end. The channel web width dimension may be configured such that a channel gap (86) exists between the channel first flange (82) and the channel second flange (83) as shown in FIG. 14 and FIG. 15. This channel gap will preferably be sized to receive a plurality of studs (70), each of which are connected to the drywall track component assembly as shown in FIG. 16.

Figure 17:
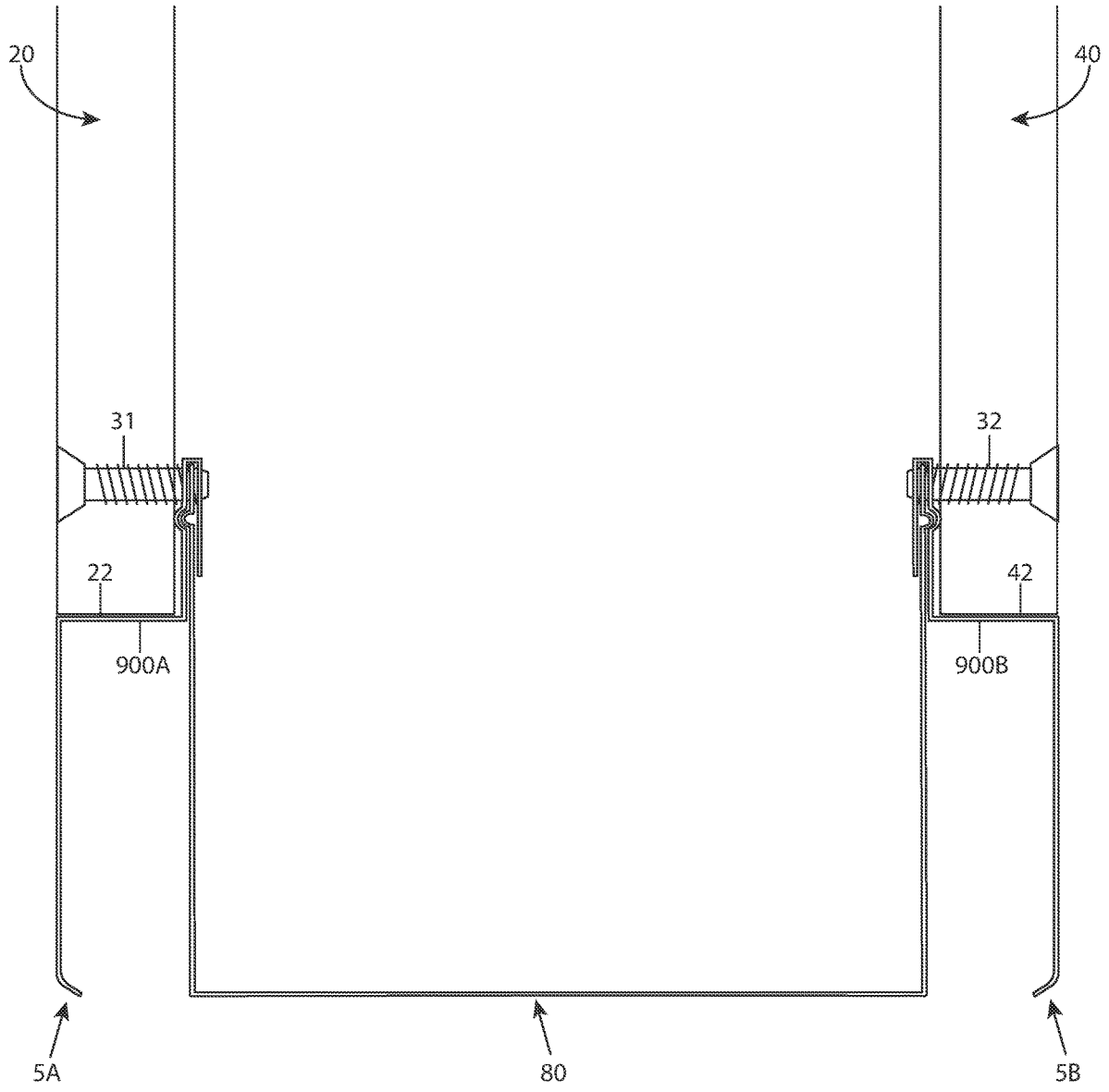
FIG. 17 is an end view of one embodiment of a drywall track component with two drywall sheets connected thereto.

The ledge (900) of each outer clip will have a ledge width dimension measured perpendicular to the ledge first edge (910). The first outer clip (5A) may be further configured to receive one or more drywall sheets. For example, in some embodiments, the first outer clip may be configured to receive at least a first drywall sheet (20) as shown in FIG. 17. Once installed, the ledge (900A) of the first outer clip is configured to abut against a bottom edge (22) of the first drywall sheet as shown in FIG. 17. The vertical track wall (830A) of the first outer clip is then configured to connect to the first drywall sheet by at least one first fastener (31) which is preferably a screw.

When present, the second outer clip (5B) may be configured to receive one or more drywall sheets. For example, in some embodiments, the second outer clip may be configured to receive at least a second drywall sheet (40) as shown in FIG. 17. Once installed, the ledge (900B) of the second outer clip is configured to abut against a bottom edge (42) of the second drywall sheet as shown in FIG. 17. The vertical track wall (830B) of the second outer clip is then configured to connected to the first drywall sheet by at least one second fastener (32) which is preferably a screw.

Figure 18:
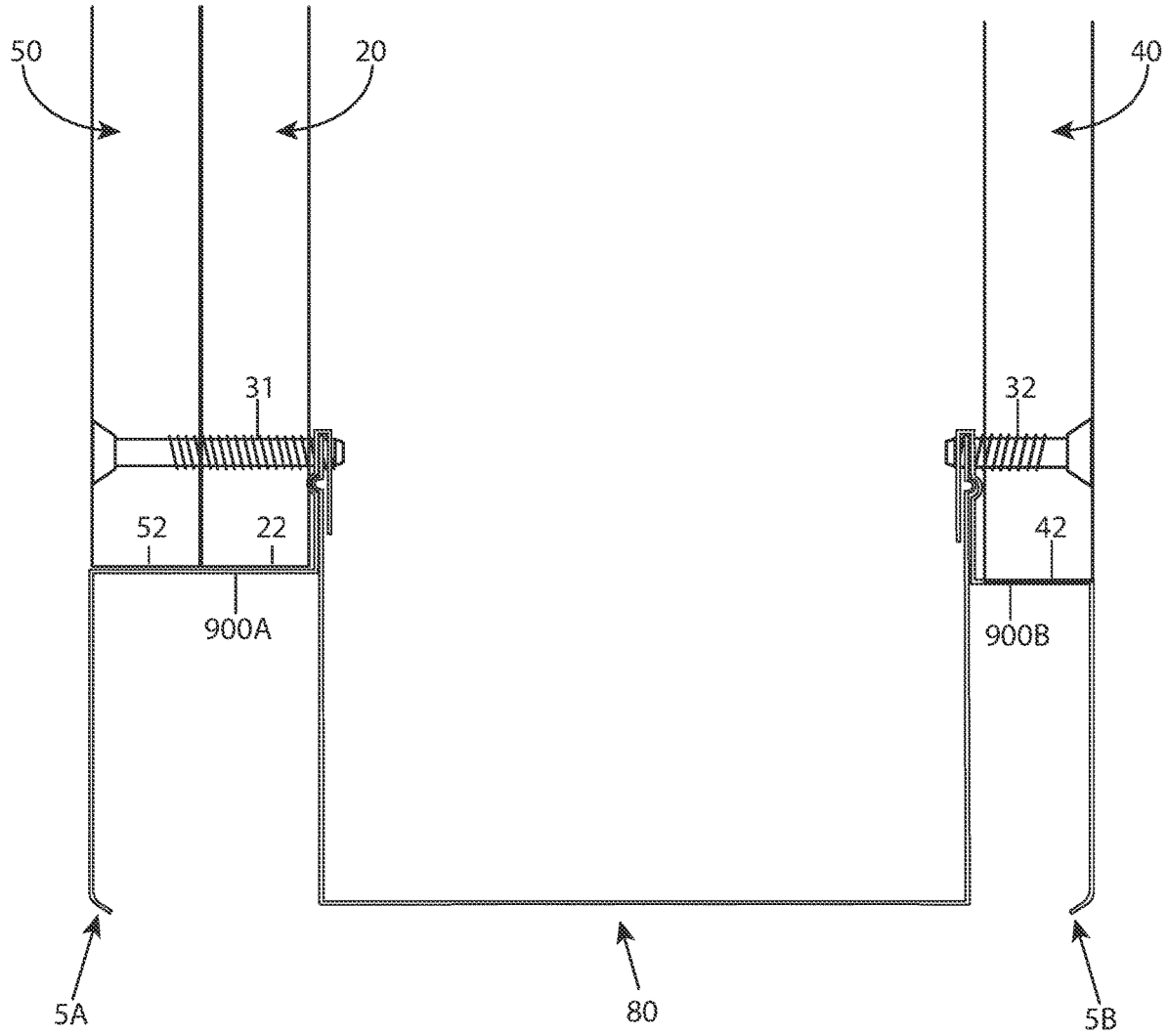
FIG. 18 is an end view of one embodiment of a drywall track component with three drywall sheets connected thereto.

In some embodiments the first outer clip (5A) may be configured to receive multiple layers of drywall. For instance, FIG. 18 shows an embodiment of a first outer clip configured to receive two layers of drywall. This may be achieved by increasing the ledge width of the first outer clip. As shown in FIG. 18, in such embodiments, the ledge (900A) of the first outer clip is configured to abut against a bottom edge (52) of the third drywall sheet (50). The vertical track wall (830A) of the first outer clip is then configured to connect to the third drywall sheet by at least the first fastener (31) which is preferably a screw that passes through both the third drywall sheet and the first drywall sheet (20) before passing into the vertical track wall of the first outer clip as shown in FIG. 18.

Figure 19:
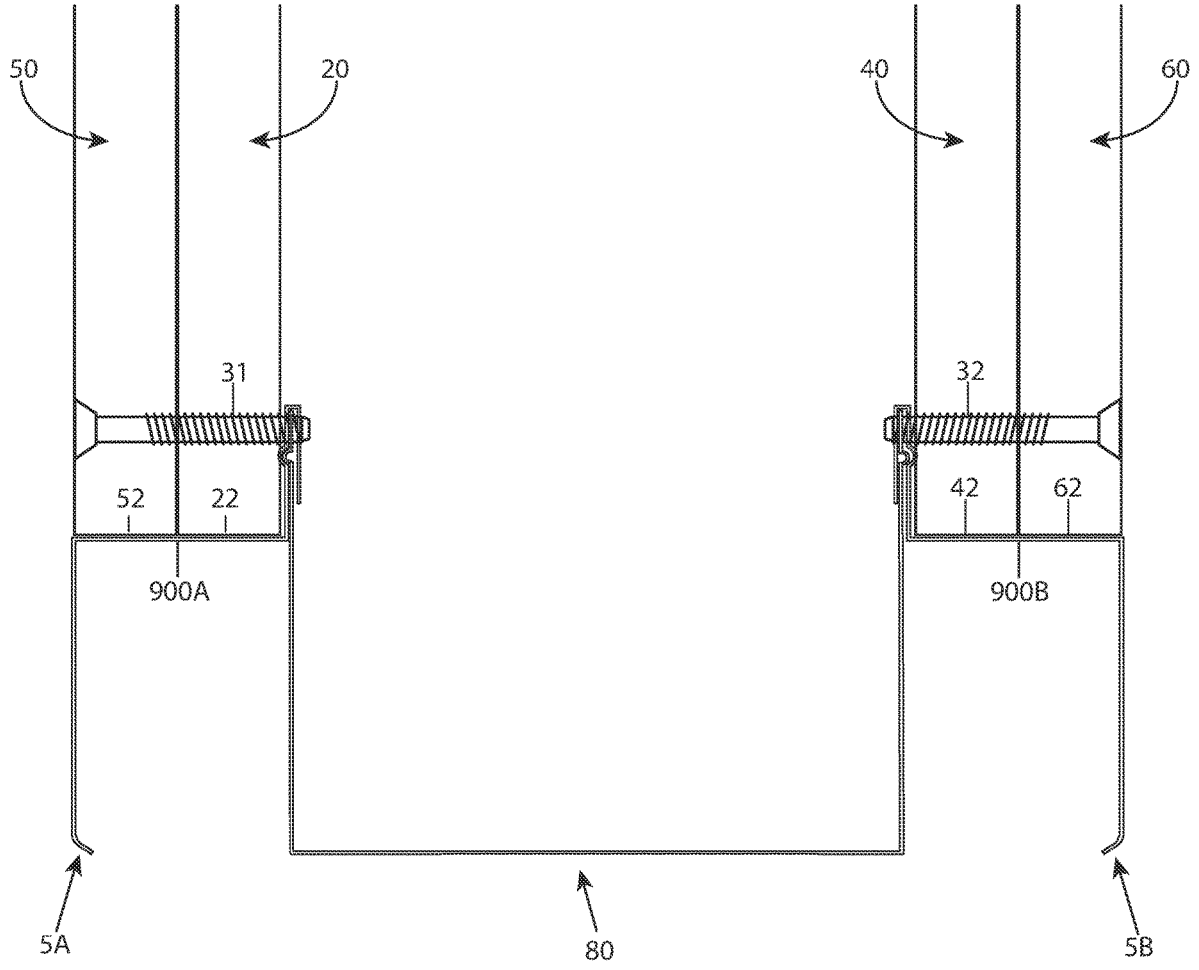
FIG. 19 is an end view of one embodiment of a drywall track component with four drywall sheets connected thereto.

Similarly, when present, the second outer clip (5B) may be configured to receive multiple layers of drywall. For instance, FIG. 19 shows an embodiment of a second outer clip configured to receive two layers of drywall. This may be achieved by increasing the ledge width of the second outer clip. As shown in FIG. 19, in such embodiments, the ledge (900B) of the second outer clip is configured to abut against a bottom edge (62) of the fourth drywall sheet (60). The vertical track wall (830B) of the second outer clip is the configured to connect to the third drywall sheet by at least the second fastener (32) which is preferably a screw that passes through both the fourth drywall sheet and the second drywall sheet (40) before passing into the vertical track wall of the second outer clip as shown in FIG. 19.

While the drywall track components, inner clips, and outer clips disclosed herein may be manufactured of any number of materials using any number of manufacturing methods, the preferred manufacturing method and material is roll forming of a metal material such as steel, in particular carbon steel as used in the experimental section. For example, the drywall track component disclosed and shown in FIG. 1 through FIG. 6 originate as a single planar piece of metal having a length of at least 2 feet, preferably at least 5 feet, more preferably at least 8 feet, and typically at least 10 feet. The preferred lengths are about 6 foot in length, with about 9 foot being the next preferred length, with about 8 feet being even more preferred. A length of about 12 feet is also preferred with a length of about 10 feet being the most preferred length. The planar piece of metal is then passed through a series of rolls to form the web, first flange, second flange, first ledge, first track wall, (optional) second ledge, and (optional) second track wall. The drywall track component disclosed herein and shown in FIG. 1 through FIG. 6 may be formed using traditional roll forming techniques in which the various bends originate from the center out. That is to say that the planar piece of metal is first exposed to rolls for forming the first flange and second flange. Next, the planar piece of metal is exposed to rolls for forming the first ledge and (optional) second ledge. Finally, the planar piece of metal is exposed to rolls for forming the first track wall and (optional) second track wall.

It was discovered that a drywall track component having two walls (such as those shown in FIG. 9 through FIG. 11 (200/7A, 300/7B) and in FIG. 14 through 19 (1000A/82, 1000B/38)) cannot be formed as a single integral piece using traditional roll forming techniques. Attempts to roll form such a drywall track component resulted in the rolls of the roll form machine jamming during formation of the inner wall. The roll form fail to produce a usable drywall track component when this jamming occurs and an operator must partially disassemble the roll forms to clear the jam.

The outer clip disclosed herein and shown in FIG. 12 and FIG. 13 may be roll formed starting from the outer clip top return lip section of the outer clip. That is to say that the planar piece of metal is first exposed to rolls for forming the outer clip lead-in, the outer clip fold, and the vertical track wall. Optionally, the planar piece of metal may be exposed to rolls for forming the ridge prior to or after exposure to the rolls for forming the outer clip lead-in, the outer clip fold, and the vertical track wall. Next, the planar piece of material may be exposed to rolls for forming the ledge, followed by the outer clip vertical wall, and finally the outer clip bottom return lip. By carefully controlling the sequence of rollers in this manner the outer clip can be roll formed without jamming the rollers.

Figure 20:
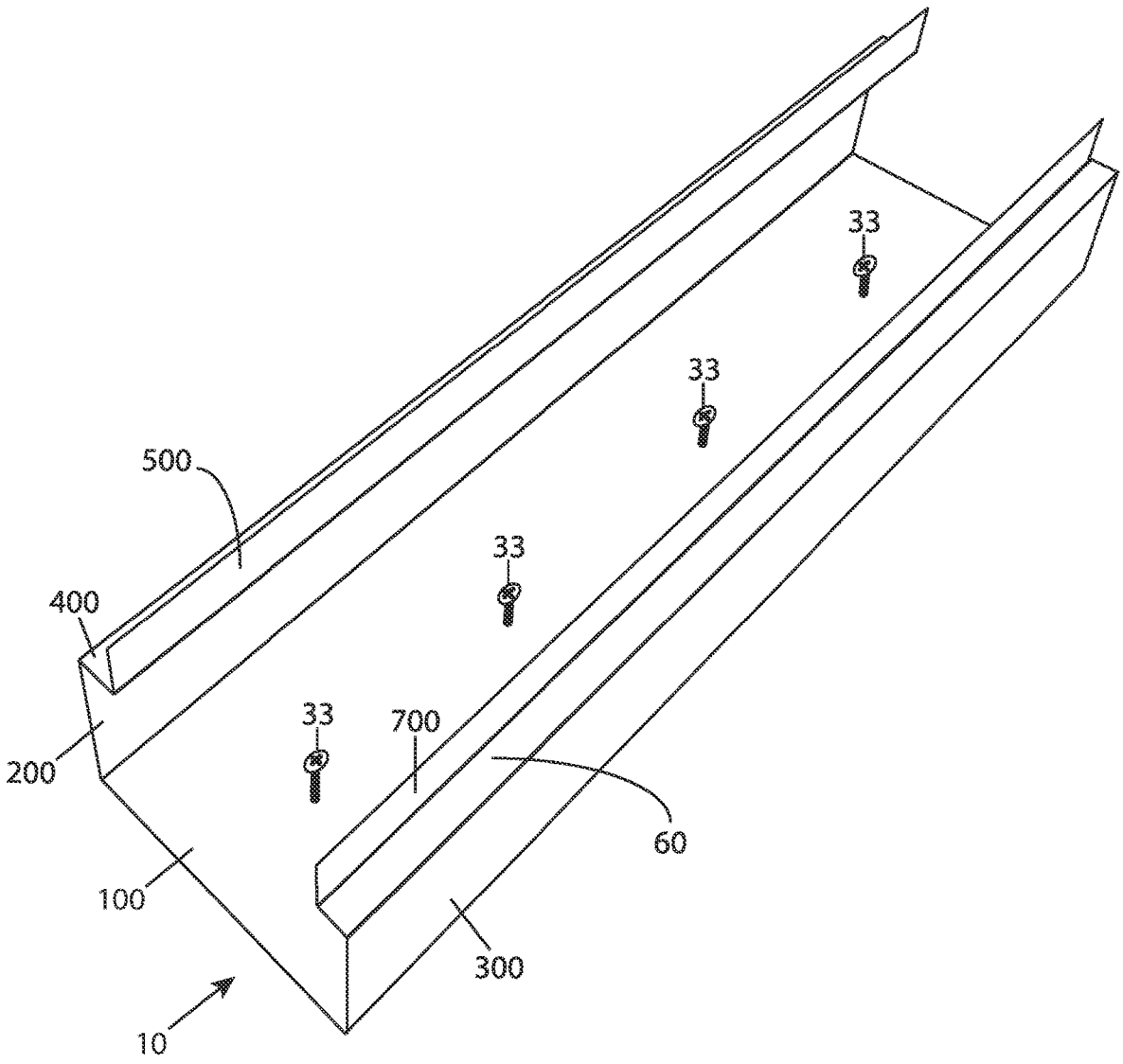
FIG. 20 is a perspective view of one embodiment of a drywall track component installed to a floor or ceiling.
Figure 21:
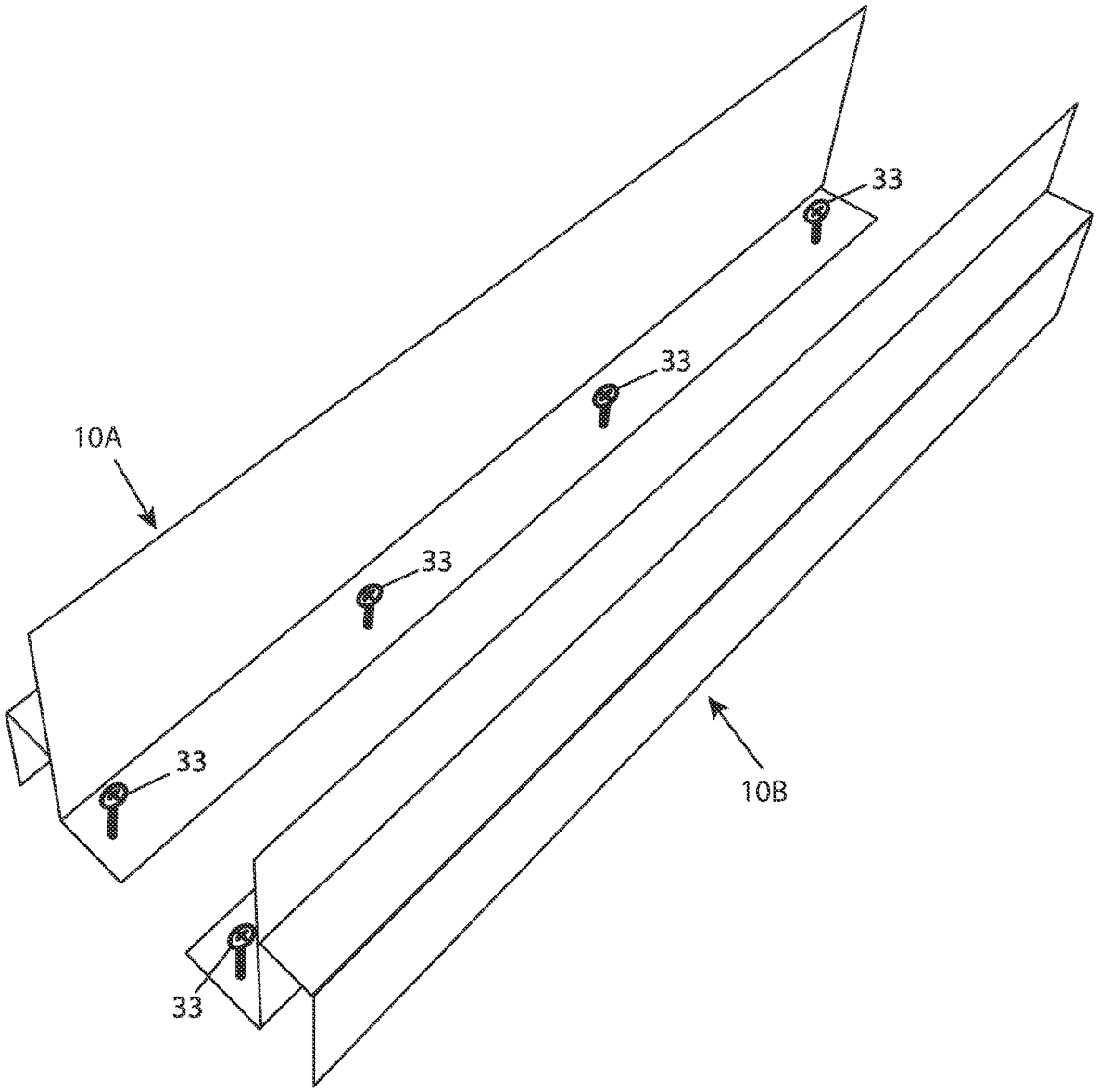
FIG. 21 (Prior Art)
FIG. 21 is a perspective view of a prior art embodiment of a drywall track component installed to a floor or ceiling.

As the drywall track components disclosed herein are attached to a floor or ceiling by a plurality of third fasteners (33) as a single integral piece of material as shown in FIG. 20, the challenges associated with prior art two component designs (as shown in FIG. 21 with 10A being the first drywall track component and 10B being the second drywall track component) are eliminated. In contrast with, and an improvement over, the two-piece prior art system, with the invented unitary drywall track, the installer can simply lay down the single unitary drywall track component and attach it to the floor or ceiling without having to align and install a second drywall track component to the floor or ceiling. This is a much easier and quicker installation that ensures a parallel alignment of the two flanges of the drywall track component to which studs can be immediately attached. In embodiments where the drywall track component further includes one or more inner clips, the inner clips can simply be friction fit onto the drywall track component before or after installation to the floor or ceiling without the need for additional fasteners and without changing the parallel alignment of the two flanges. Similarly, in embodiments where the drywall track component further includes one or more outer clips, the outer clips can simply be friction fit onto the channel before or after installation to the floor or ceiling without the need for additional fasteners and without changing the parallel alignment of the two flanges.

A preferred material of construction for the drywall track component may be carbon steel. The carbon steel may be TYPE B (i.e. CSB) grade. The steel may or may not be galvanized and could be G40 or G90 or G140 designations. The steel may have a 33 ksi tensile strength. The thickness of track component steel could be 0.019" or other industry standard steels for interior non-load bearing track. While non-load bearing track is preferred, a load bearing track is also contemplated.

The drywall track components disclosed herein also achieve other benefits associated with prior art drywall tracks that support drywall above the floor such as those disclosed in U.S. Pat. No. 8,596,019 B2 and U.S. Pat. No. 10,487,497 B1. Specifically, by supporting the drywall above the floor, the drywall track components disclosed herein protect the drywall sheets from water and other damage—such as that which may occur from floor cleaning equipment. The drywall track components shown in FIG. 9 through FIG. 11 and in FIG. 14 through FIG. 19 also serve as an insulator for fire and sound by forming an air pocket between the two walls (200/7A, 300/7B, 1000A/82, or 1000B/83). For fire, the drywall track components shown in FIG. 9 through FIG. 11 and in FIG. 14 through FIG. 19 are capable of achieving a 1 hour or 2 hour fire rating when measured according to ASTM E-119-20 updated as of Jun. 9, 2020.

EXPERIMENTAL

The track component embodiment shown in FIG. 10 was assembled with metal studs and a double layer gypsum wall on both sides. These components were manufactured under the guidelines of the SFIA Code Compliance Certification Program. The gypsum board met ASTM C1396 at time of filing.

The fire exposure tests were conducted under non-load-bearing conditions according ASTM E-119-20 updated as of Jun. 9, 2020 and the specimens then submitted to the ASTM E2226-15b(2019) hose stream test under non-loadbearing conditions. The assembly met the Conditions of Acceptance of ASTM E-119 when exposed to a fire resistance rating of 120 minutes.

What is claimed is:

1. An assembly comprising a drywall track component (10) and an inner clip (7), with the drywall track component having a web (100) having a web first edge (110), a web second edge (120), a web first end (130), and a web second end (140);

a first flange (200) extending substantially perpendicular from the web first edge, said first flange having a first flange first edge (210), a first flange second edge (220), a first flange first end (230), and a first flange second end (240);

a second flange (300) extending substantially perpendicular from the web second edge, said second flange having a second flange first edge (310), a second flange second edge (320), a second flange first end (330), and a second flange second end (340);

a first ledge (400) extending substantially perpendicular from the first flange second edge in a first direction towards the second flange, said first ledge having a first ledge first edge (410), a first ledge second edge (420), a first ledge first end (430), and a first ledge second end (440); and a first track wall (500) extending substantially perpendicular from the first ledge second edge in a second direction away from the web, said first track wall having a first track wall first edge (510), a first track wall second edge (520), a first track wall first end (530), and a first track wall second end (540);

a first inner clip (7A) having a first inner clip top return lip (1100) comprising a first inner clip lead-in (1110) and a first inner clip fold (1120), a first inner clip vertical wall (1130), a first inner clip bottom return lip (1140) wherein the first inner clip top return lip is configured to connect to the first track wall (500) or a second track wall (700) of the drywall track component; and a second inner clip (7B)

a second inner clip top return lip (1100) comprising a second inner clip lead-in (1110) and a second inner clip fold (1120), a second inner clip vertical wall (1130), a second inner clip bottom return lip (1140) wherein the second inner clip top return lip is configured to connect to the first track wall (500) or the second track wall (700) of the drywall track component;

wherein the first inner clip is removably connected to the first track wall by passing the first inner clip top return lip (1100A) over the first track wall; and wherein the second inner clip is removably connected to the second track wall by passing the second inner clip top return lip (1100B) over the second track wall.

* * * * *